US010188956B2

(12) United States Patent
Morales

(10) Patent No.: US 10,188,956 B2
(45) Date of Patent: Jan. 29, 2019

(54) ASSEMBLY-TYPE EVOLUTIONARY GAME SYSTEM

(71) Applicant: ORGANIC CONSTRUCTION SYSTEM, S.A. DE C.V., Colonia Lomas Altas, Mexico City (MX)

(72) Inventor: Jose Manuel Torner Morales, Mexico City (MX)

(73) Assignee: ORGANIC CONSTRUCTION SYSTEM, S.A. DE C.V., Mexico City (MX)

( * ) Notice: Subject to any disclaimer, the term of this patent is extended or adjusted under 35 U.S.C. 154(b) by 45 days.

(21) Appl. No.: 15/056,554

(22) Filed: Feb. 29, 2016

(65) Prior Publication Data

US 2017/0100677 A1 Apr. 13, 2017

(30) Foreign Application Priority Data

Oct. 12, 2015 (CN) ..... 2015 2 0789387 U

(51) Int. Cl.

| | |
|---|---|
| ***A63H 3/16*** | (2006.01) |
| ***A63H 3/46*** | (2006.01) |
| ***A63H 33/00*** | (2006.01) |
| ***A63H 33/06*** | (2006.01) |
| ***A63H 33/08*** | (2006.01) |
| ***A63H 33/10*** | (2006.01) |

(52) U.S. Cl.

CPC ..... *A63H 3/16* (2013.01); *A63H 3/46* (2013.01); *A63H 33/003* (2013.01); *A63H 33/062* (2013.01); *A63H 33/086* (2013.01); *A63H 33/103* (2013.01)

(58) Field of Classification Search

CPC .. A63H 33/003; A63H 33/062; A63H 33/086; A63H 33/103; A63H 3/16; A63H 3/46

USPC ... 446/97, 99, 368, 373, 374, 375, 376, 382, 446/383

See application file for complete search history.

(56) References Cited

U.S. PATENT DOCUMENTS

| | | | | |
|---|---|---|---|---|
| 2,752,726 A * | 7/1956 | Calverley | A63H 3/16 | 403/142 |
| 5,498,190 A * | 3/1996 | Ganson | A63H 33/04 | 446/107 |
| 5,752,869 A * | 5/1998 | Huff | A63H 3/16 | 446/102 |
| 5,941,712 A * | 8/1999 | Smith | A63H 3/16 | 273/157 R |
| 6,234,858 B1 * | 5/2001 | Nix | A63H 3/08 | 446/101 |
| 6,626,732 B1 * | 9/2003 | Chung | A63H 3/08 | 446/114 |

(Continued)

*Primary Examiner* — Melba Bumgarner
*Assistant Examiner* — Joseph B Baldori
(74) *Attorney, Agent, or Firm* — Millen, White, Zelano & Branigan, P.C.; William Nixon

(57) ABSTRACT

The evolutionary game system includes a combination of malleable and rigid pieces that are assembled on a series of structural ribs malleable to generate the body and limbs of a diverse number of animals. The system includes extendable components of a base body. The system also includes structural joint pieces of the base body and rigid components of the base body. The evolutionary game system allows for a combination of shapes and is adaptable to constant and demanding changes that are required by children for their games.

15 Claims, 36 Drawing Sheets

(56) References Cited

U.S. PATENT DOCUMENTS

| | | | | |
|---|---|---|---|---|
| 7,267,598 | B2 * | 9/2007 | Glickman | A63H 33/086 446/120 |
| 7,862,399 | B1 * | 1/2011 | Culpepper | A63H 3/16 206/575 |
| 8,834,225 | B2 * | 9/2014 | Ferron | A63H 33/107 446/117 |
| 9,283,491 | B2 * | 3/2016 | Pope-Gusev | A63H 33/008 |
| 9,610,512 | B2 * | 4/2017 | Bae | A63H 3/16 |
| 2005/0113177 | A1 * | 5/2005 | Kuo | A63H 33/084 472/1 |
| 2008/0003917 | A1 * | 1/2008 | Norman | A63F 9/08 446/97 |
| 2010/0041300 | A1 * | 2/2010 | Bevirt | F16M 11/40 446/97 |
| 2010/0221975 | A1 * | 9/2010 | Kimbrough | A63H 3/04 446/99 |
| 2013/0122776 | A1 * | 5/2013 | Gabai | A63H 3/46 446/104 |
| 2016/0107092 | A1 * | 4/2016 | Bae | A63H 33/086 446/368 |

* cited by examiner

Fig.-2
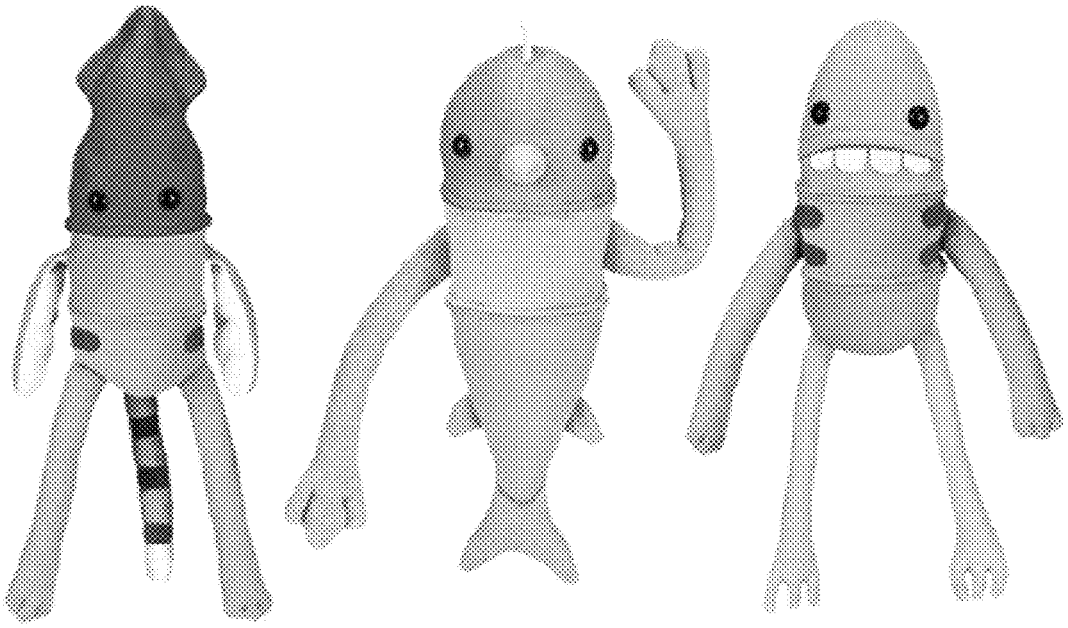
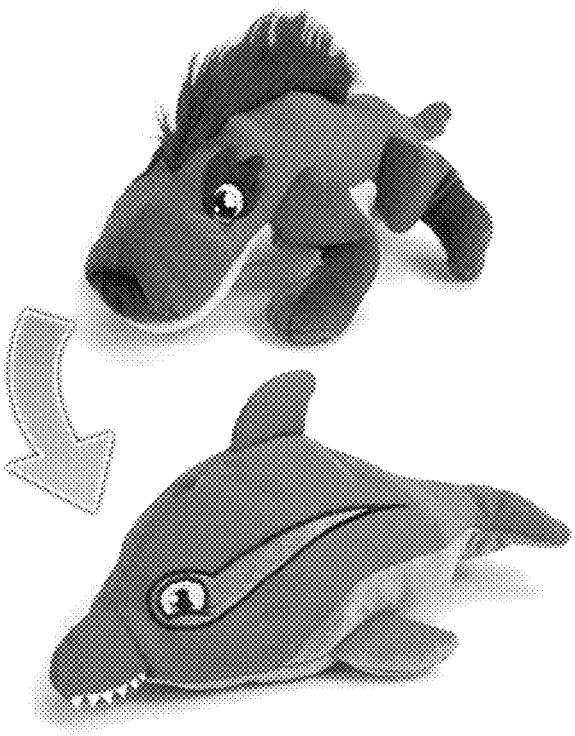
Fig.-3

Fig.- 37
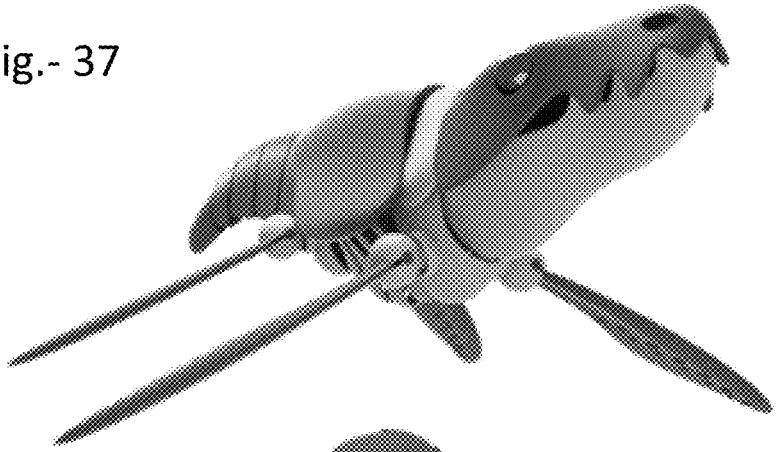
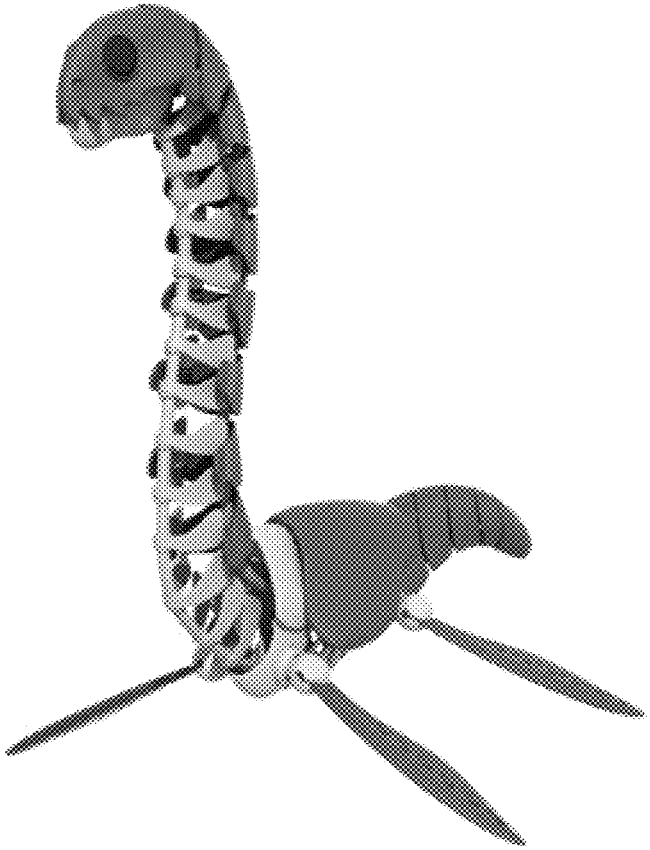
Fig.- 38

Fig.- 39
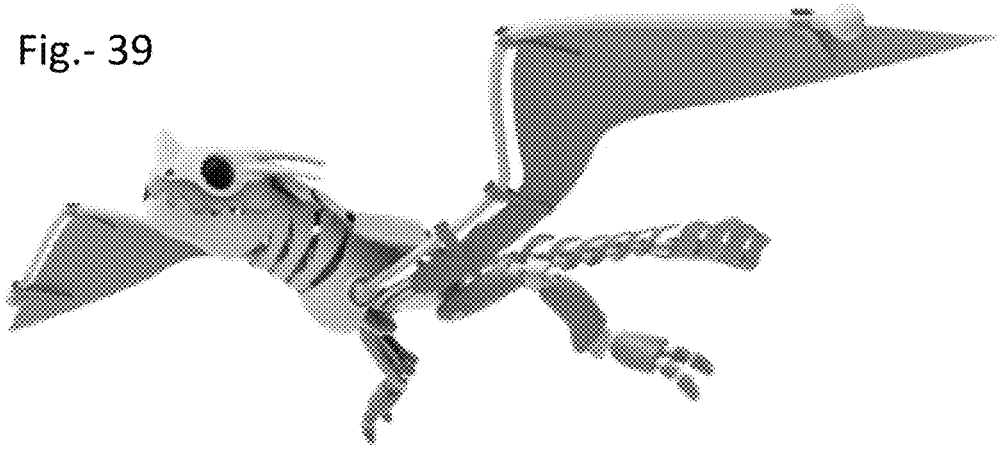
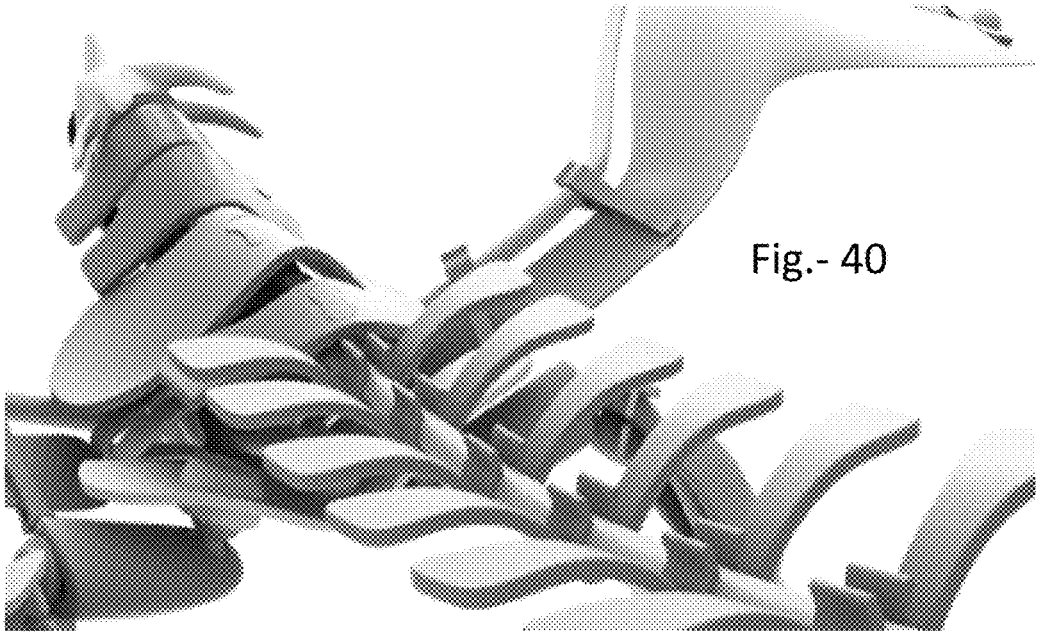
Fig.- 40

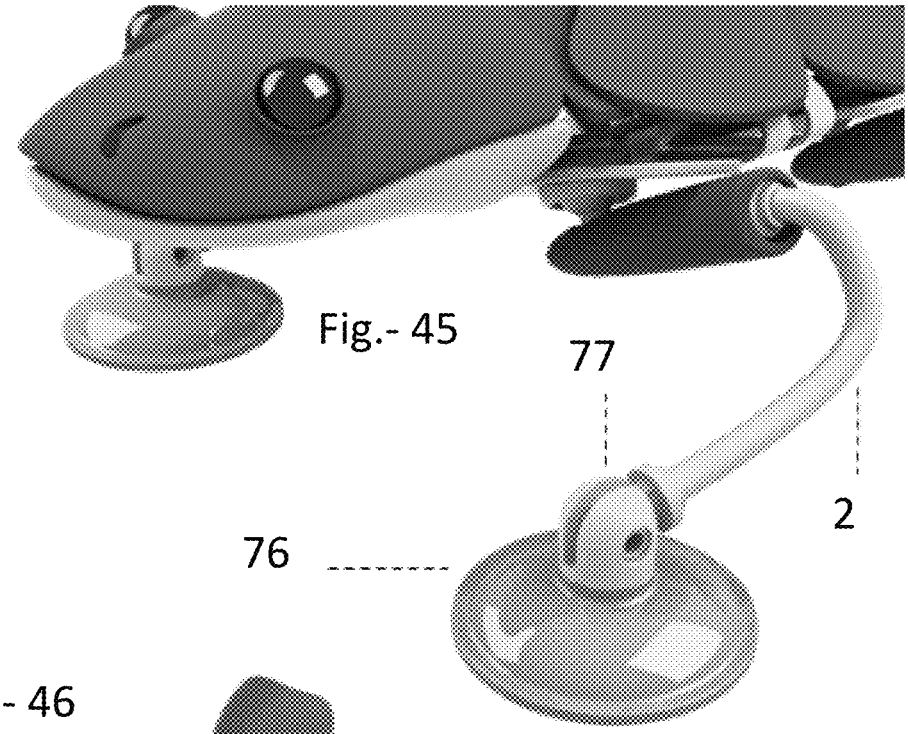
Fig.- 45
Fig.- 46
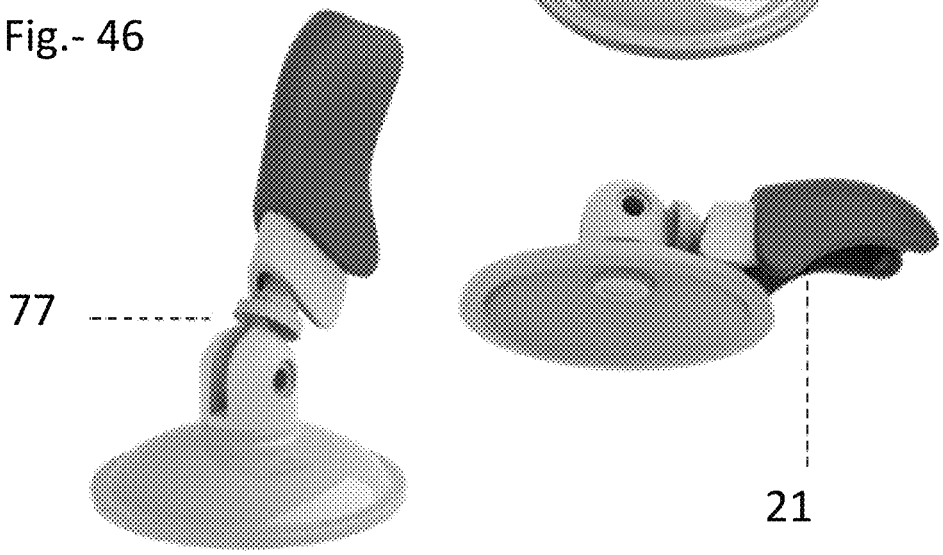

Fig.- 52
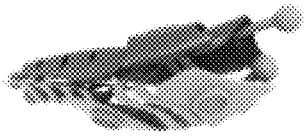
Fig.- 22
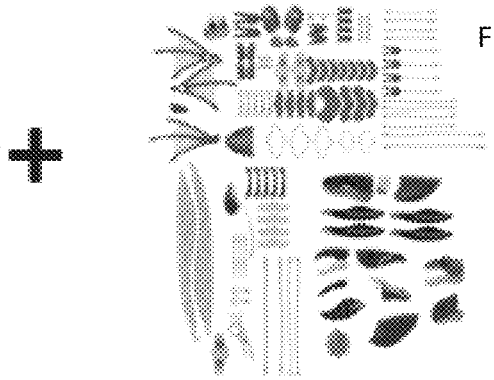
Figs.- 4 y 5
Fig.- 34
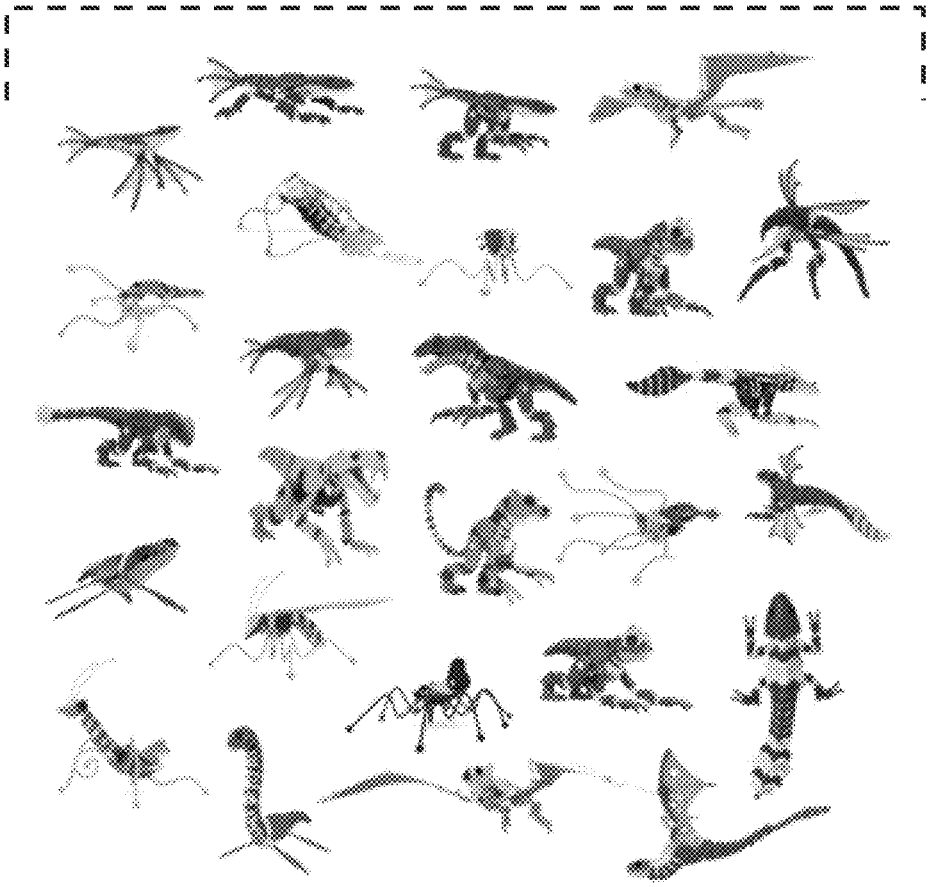

ASSEMBLY-TYPE EVOLUTIONARY GAME SYSTEM

TECHNICAL FIELD

The present utility model relates to an assembly-type evolutionary game system, which permits a user to rearrange a target in all kinds of possible ways by exchanging and changing component modules of the system. Upgrading of the toy is the concept of various possible additions and changes, in other words, taking a backbone as a foundation, the user can assemble different animals, and increase the diversity, scale and degree of complex diversification thereof through the gradual addition of components.

BACKGROUND ART

There is a vast supply of toys on the market, but the problem is that despite the never-ending development of technology and production quality, children are losing interest in toys more and more quickly. This causes a strain on the household economy and deprives children of amusement.

The main problem is that industrial toys go out of date too quickly. These toys are limited in terms of their ability to encourage a child's development and will therefore be forgotten very quickly as technology develops and trends change.

FIG. 1 shows images of some animals formed of plastic pieces in an assembly-type game system which is already on the market. FIG. 2 shows images of animals with interchangeable components which form hybrid animals, and of animals produced using woven materials. FIG. 3 shows images of animals of woven materials which can "evolve" into animal ancestors or descendants.

By and large, other assembly-type game systems in the prior art are all sets of rigid components, which can be used for connecting various configurations to construct various corresponding targets, such as vehicles, building spaces or machines.

Furthermore, other assembly toys in the prior art all have unfavorable elements; grit, mud or damp air will damage the connecting system or rust exposed metal components.

Content of the Utility Model

The object of the present utility model is to solve the above problem in the prior art.

The assembly-type evolutionary game system of the present utility model fills a gap that has not been directly researched in depth in the case of other assembly-type game systems, and represents an organic design. Direct competitors of the assembly-type evolutionary game system are currently unable to satisfy users in terms of appearance or function.

Another important gap in exploration is outdoor toys. The assembly-type evolutionary game system of the present utility model can not only be used in these environments, but can invite users to take part in recreational activities of this sort. The theme of animals is both a reason and an objective.

The present utility model relates to an assembly-type evolutionary game system, which is formed by connecting the following components: extendable components of a base body which comprise: a body abdomen-side part; a first body back-side part; a second body back-side part; a third body back-side part; a fourth body back-side part; a fifth body back-side part; and a sixth body back-side part; structural joint pieces of the base body which comprise: a short straight connection structural joint piece; a middle straight connection structural joint piece; a long straight connection structural joint piece; a middle spherical connection structural joint piece; a long spherical connection structural joint piece; a mixed connection structural joint piece; and a hand structural joint piece; and rigid components of the base body which comprise: a narrow rib; a narrow limb connection main body; a thigh; a flat rib; a flat limb connection main body; a knee; an ankle; a foot; a wing; a shin; a fish tail piece; a single tail piece; a reptile head comprising skull and jaw; a crest; a fish head comprising skull and jaw; a head connection component; a front arm; an elbow and wrist component; and an arm.

In a preferred embodiment, connections between parts are achieved by two different types of male/female connectors.

In a preferred embodiment, a first type of male/female connector connection is achieved by a spherical round head entering a hemispherical connector under pressure, so as to allow free rotation.

In a preferred embodiment, a second type of male/female connector connection is achieved by radially arranged equidistantly distributed shafts directly entering a cavity.

In a preferred embodiment, assembled toys are an insect, fish, amphibian, reptile and lizard.

In a preferred embodiment, a part of the base body can also be connected to the following components: a special main body module; a head; a crest; a limb; a tail piece; a wing; a long thin claw; and a thick claw.

In a preferred embodiment, an assembled toy is a dinosaur, mammal, insect, marine reptile, amphibian or dragon.

DESCRIPTION OF THE ACCOMPANYING DRAWINGS

FIG. 2 shows images of animals with interchangeable components which form hybrid animals, and of animals produced using woven materials.

FIG. 3 shows images of animals of woven materials which can "evolve" into animal ancestors or descendants.

FIG. 37 shows a picture of a pliosaurus from a marine reptile expansion pack.

FIG. 38 shows a picture of a plesiosaurus from a marine reptile expansion pack.

FIG. 39 shows a picture of a certain pterosaur from an expansion pack of the same name.

FIG. 40 shows a picture of a certain pterosaur from an expansion pack of the same name, showing in detail a pressure-bearing shaft coupling.

FIG. 45 shows a picture of "suction pad" accessories for the regions of the four limbs.

FIG. 46 shows a view of an accessory installed on a front limb component; an ankle joint can be seen.

FIG. 52 shows a picture of a summary of various configuration possibilities obtained by summarizing the basic animal body in FIG. 22 and the components in FIGS. 4, 5 and 34.

PARTICULAR EMBODIMENTS

In this assembly-type evolutionary game system, as its name indicates, a toy is adapted to a child's recreation environment and conditions through progressive evolution. This is a toy which is suited to and guided by the user, and has no setting conditions. The world of toys is very similar to an ecological system; natural selection will eliminate competition which deviates from the objective. The game system can extend its service life by means of continuously adapting machinery.

Figure 23:
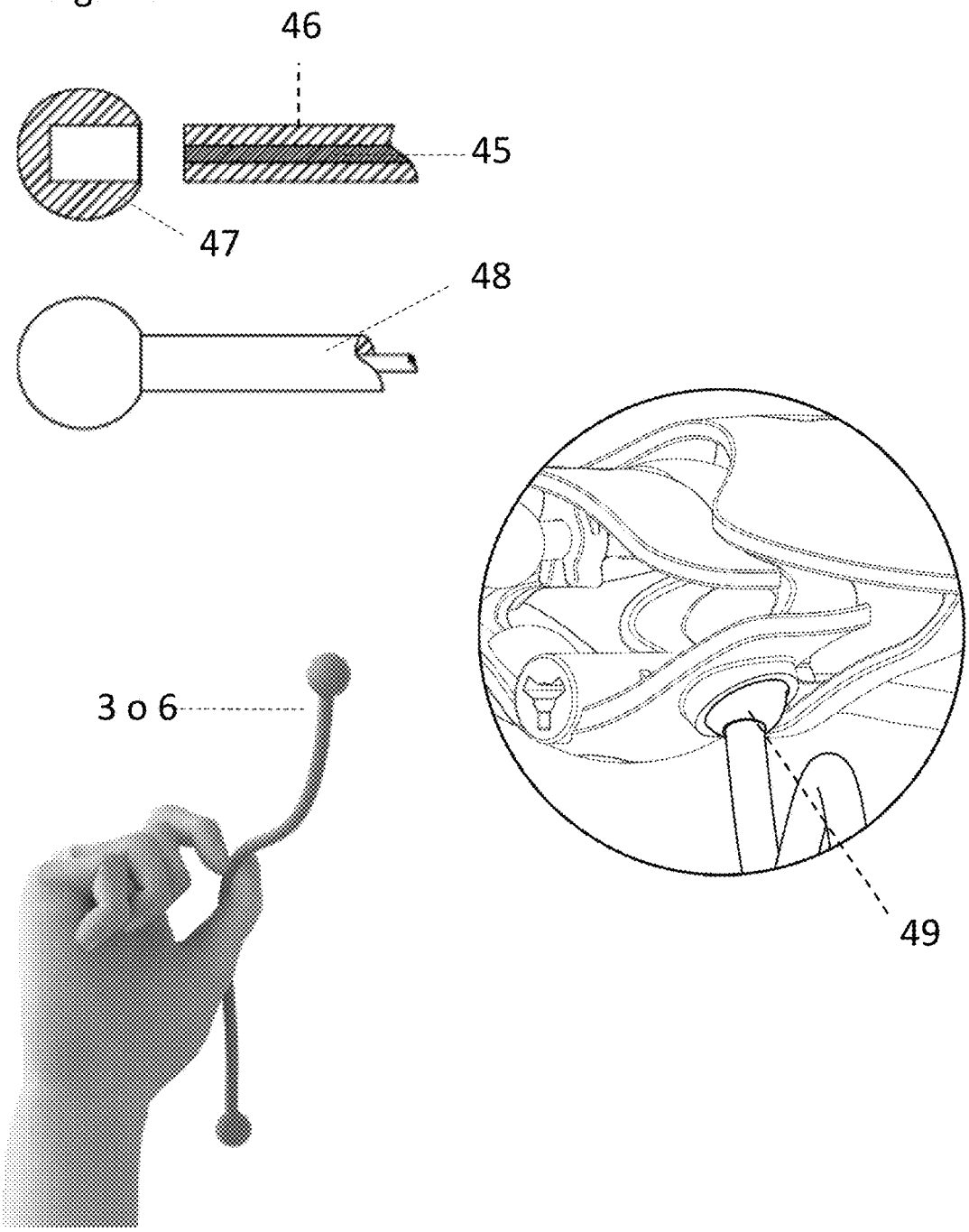
FIG. 23 shows a side section of a round structural joint rib eye, a side view of the exterior of a round structural joint piece, and a structural joint piece associated with a hand.
Figure 24:
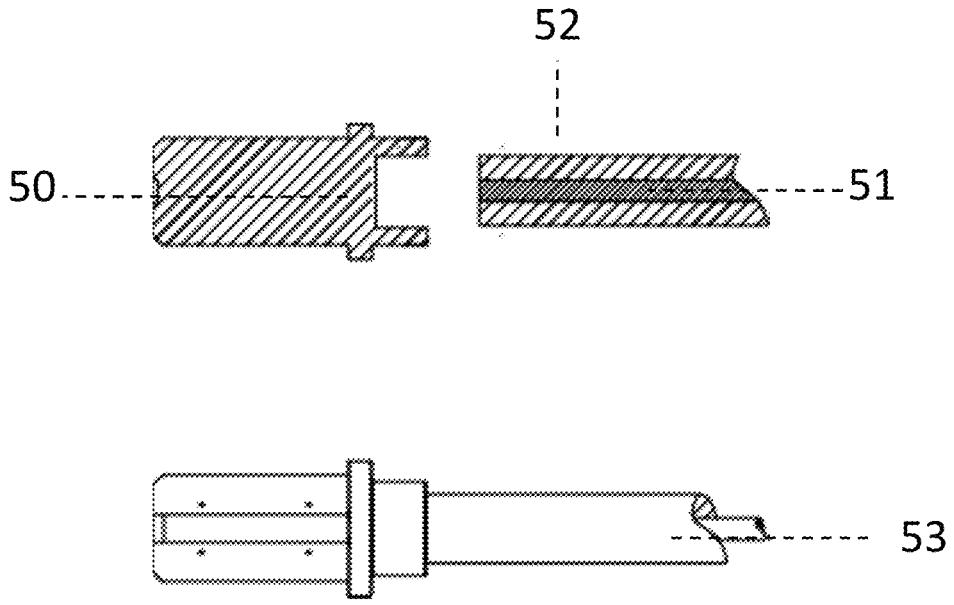
FIG. 24 shows a side section of a straight connection structural joint piece, and a side view of the outside of a straight connection structural joint piece sheet.

To realize the objective thereof as a durable children's toy, the evolutionary game system relies mainly on continuous growth and diversification for realization; this is an unfinished objective. To enable the user to make selections/configurations freely, this system employs the method of connecting independent modules by means of connectors of different types (FIGS. 23 and 24). Each component in the figures corresponds to a part of an animal body; there are modules for a head, trunk, four limbs and a tail.

Figure 1:
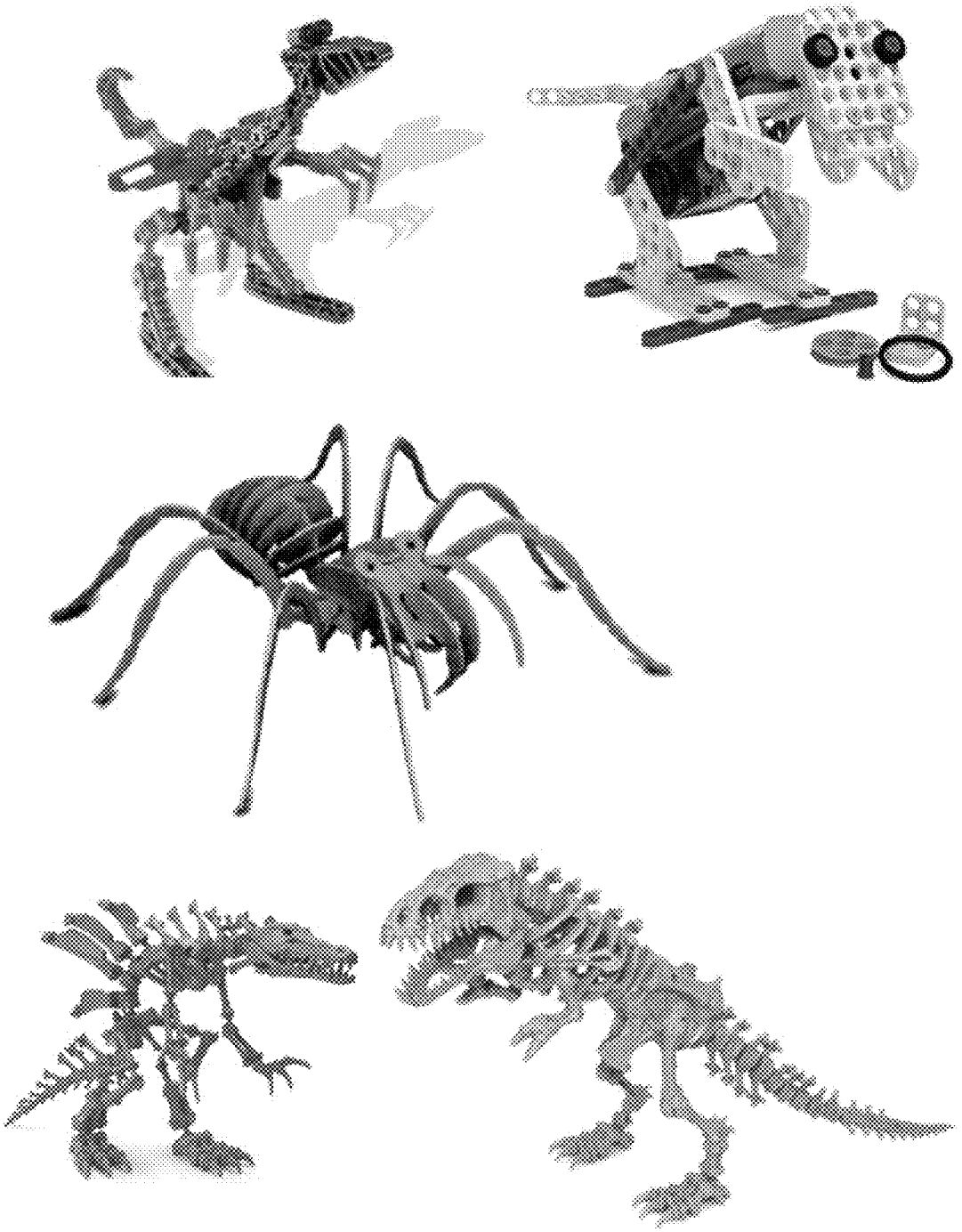
FIG. 1 shows images of some animals formed of plastic pieces in an assembly-type game system which is already on the market.
Figure 4:
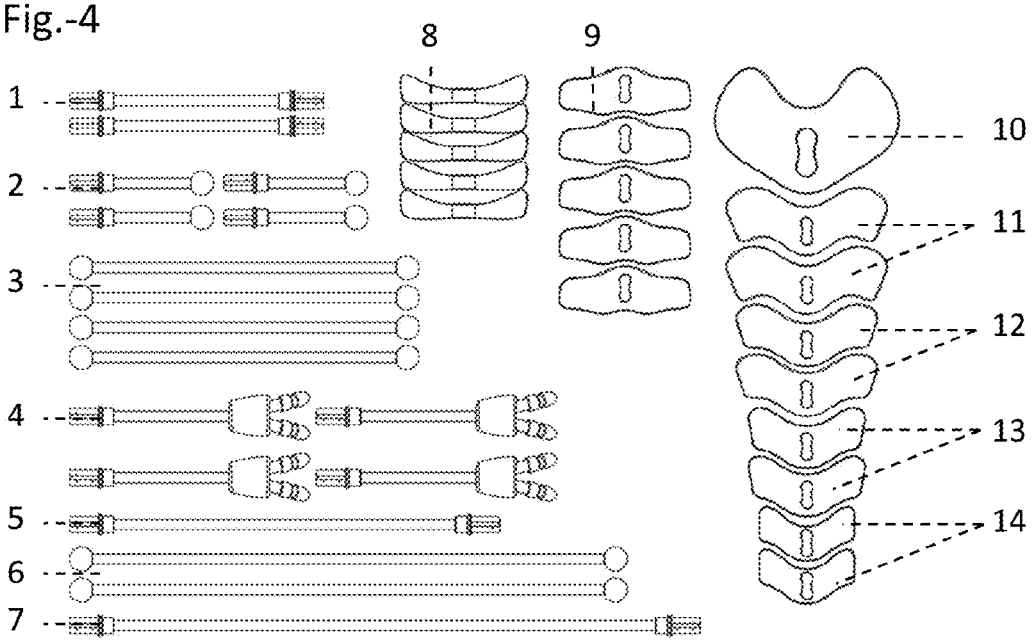
FIG. 4 shows a detailed view from above of 37 forged/cast pieces which form a product in an embodiment of the assembly-type evolutionary game system of the present utility model.

FIG. 4 shows a detailed view from above of 37 forged/cast pieces which form a product in an embodiment of the assembly-type evolutionary game system of the present utility model. Inside these components is contained a metal array, permitting the user to extend and adjust the proportions of these elements at will. List of extendable parts: a short straight connection structural joint piece 1, e.g. two pieces; a short mixed connection structural joint piece 2, e.g. four pieces; a middle spherical connection structural joint piece 3, e.g. four pieces; a hand structural joint piece 4, e.g. four pieces; a middle straight connection structural joint piece 5, e.g. one piece; a long spherical connection structural joint piece 6, e.g. two pieces; a long straight connection structural joint piece 7, e.g. one piece; a body abdomen-side part 8, e.g. five pieces; a first body back-side part 9, e.g. five pieces; a second body back-side part 10, e.g. one piece; a third body back-side part 11, e.g. two pieces; a fourth body back-side part 12, e.g. two pieces; a fifth body back-side part 13, e.g. two pieces; a sixth body back-side part 14, e.g. two pieces. The component names are all suggested methods of use; in practice, the user can rearrange the order and functions of these components within a range of connection possibility permitted by the product.

Figure 5:
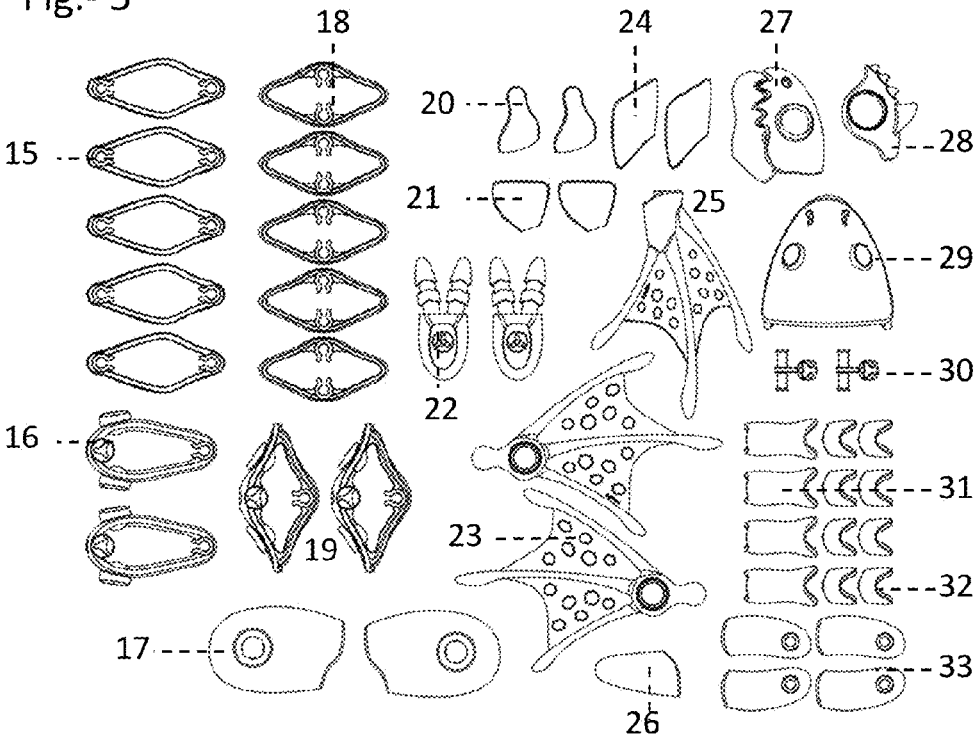
FIG. 5 shows a detailed view from above of 51 rigid components which form a product in an embodiment of the assembly-type evolutionary game system of the present utility model.

FIG. 5 shows a detailed view from above of 51 rigid components which form a product in an embodiment of the assembly-type evolutionary game system of the present utility model. No metal array is contained inside these components. These components are: a narrow rib 15, e.g. five pieces; a narrow limb connection main body 16, e.g. two pieces; a thigh 17, e.g. two pieces; a flat rib 18, e.g. four pieces; a flat limb connection main body 19, e.g. two pieces; a knee 20, e.g. two pieces; an ankle 21, e.g. two pieces; a foot 22, e.g. two pieces; a wing 23, e.g. two pieces; a shin 24, e.g. two pieces; a fish tail piece 25, e.g. two pieces; a single tail piece 26, e.g. one piece; a reptile head 27 comprising skull and jaw, e.g. one piece; a crest 28, e.g. one piece; a fish head 29 comprising skull and jaw, e.g. one piece; a head connection component 30, e.g. two pieces; a front arm 31, e.g. four pieces; an elbow and wrist component 32, e.g. eight pieces; an arm 33, e.g. four pieces. The component names are all suggested methods of use; in practice, the user can rearrange the order and functions of these components within a range of connection possibilities permitted by the product.

Figure 6:
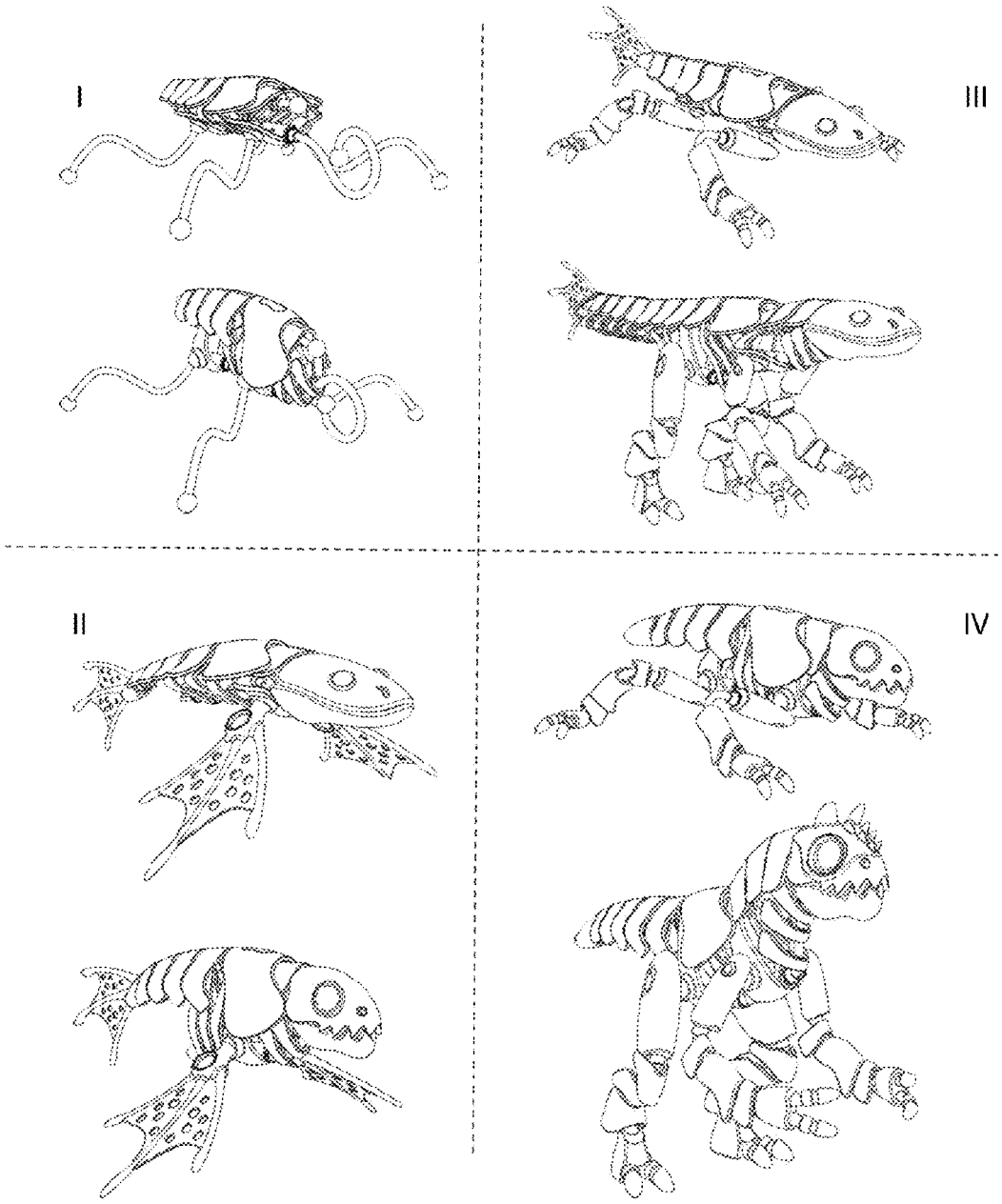
FIG. 6 shows four evolution branches specified in a basic box.
Figure 7:
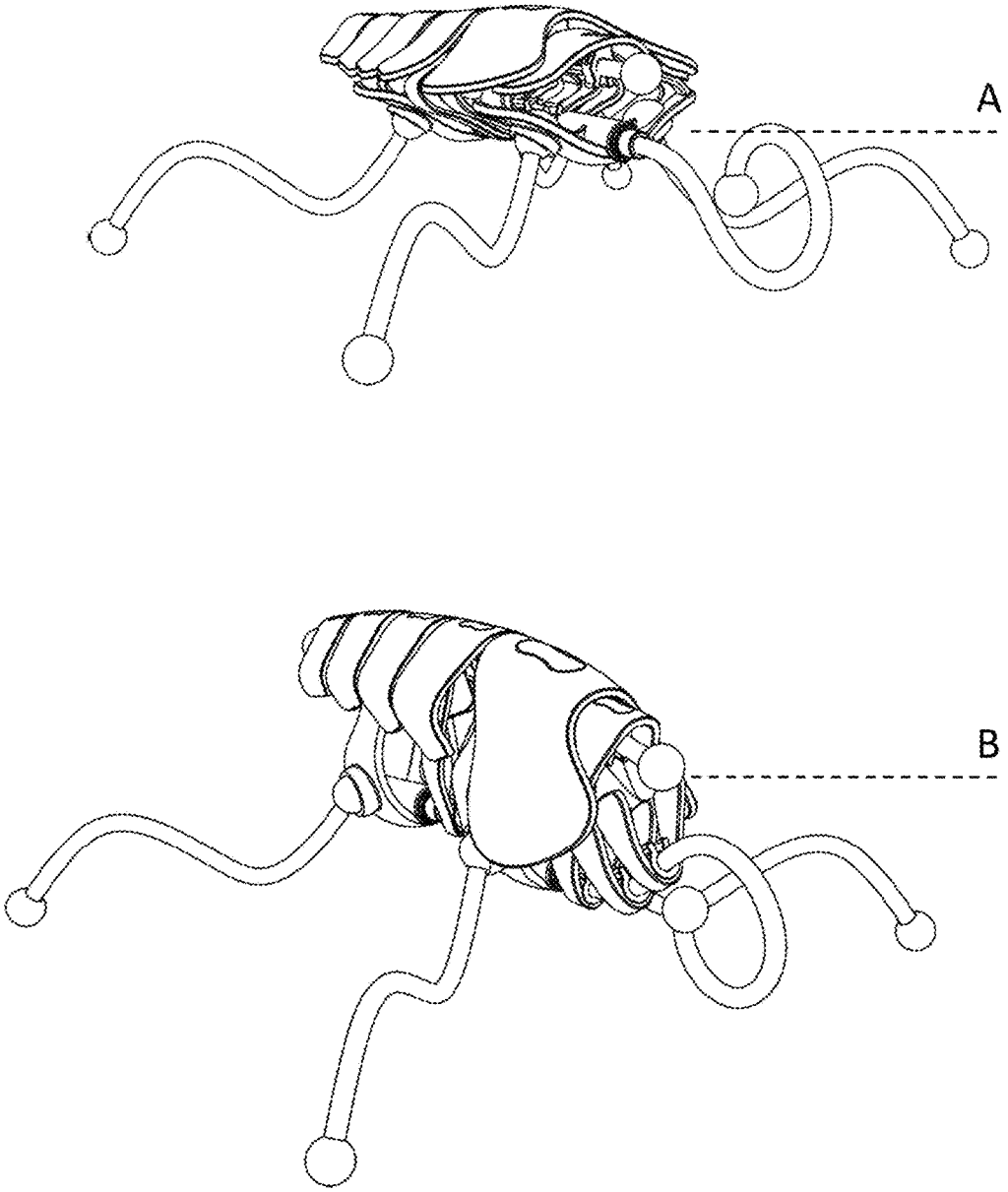
FIG. 7 shows a first embodiment of two possible insects.
Figure 8:
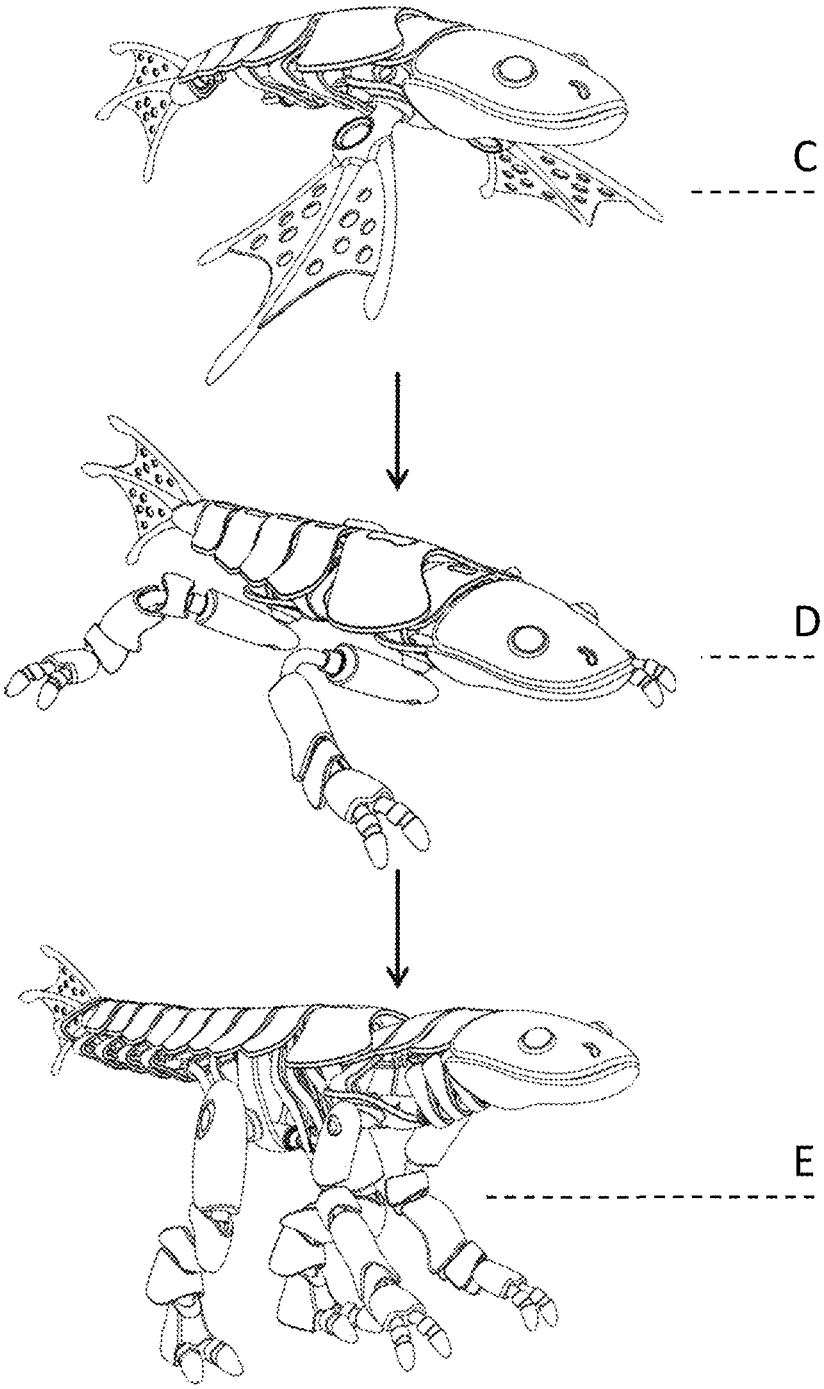
FIG. 8 shows a second evolution scheme.
Figure 9:
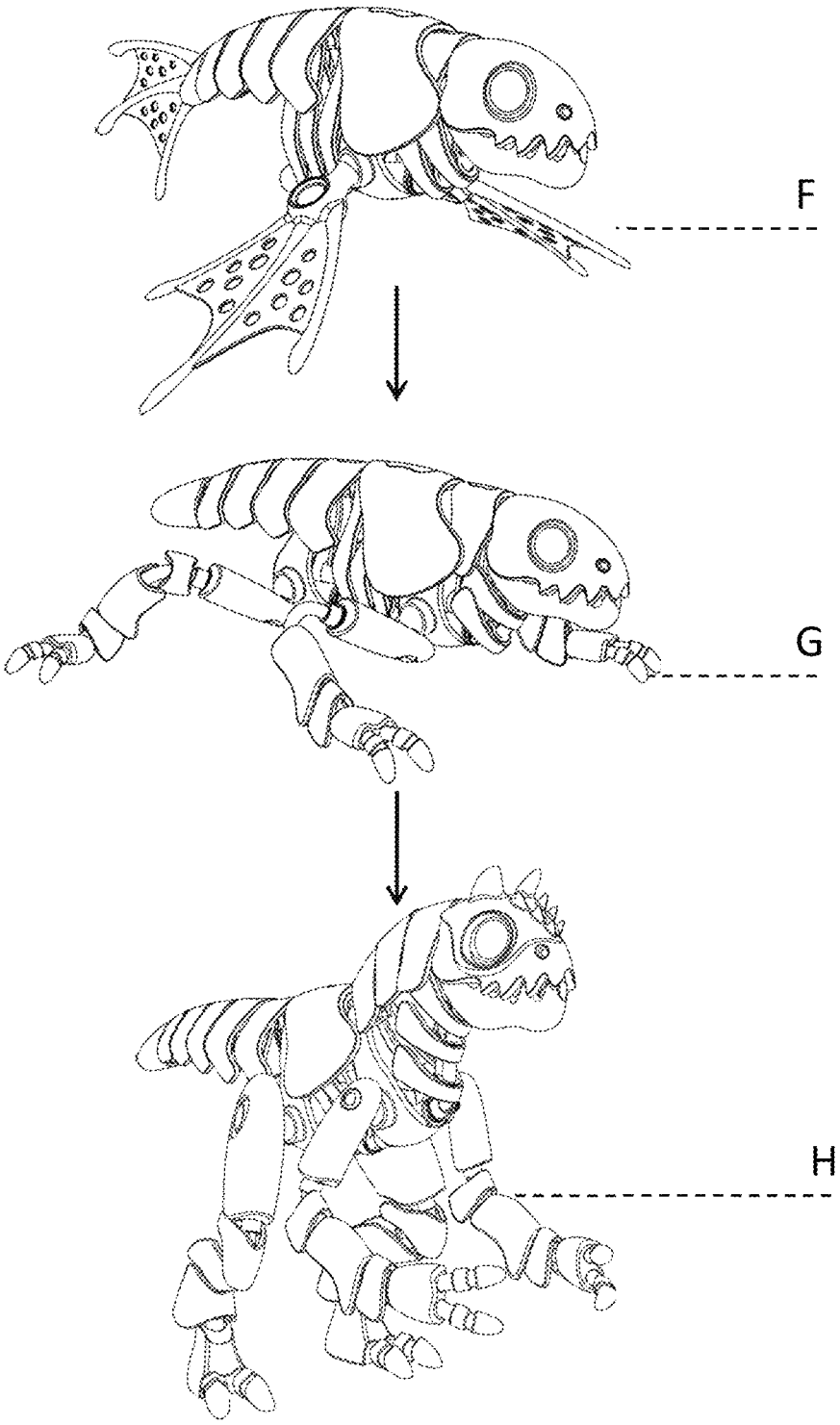
FIG. 9 shows a third evolution scheme.
Figure 10:
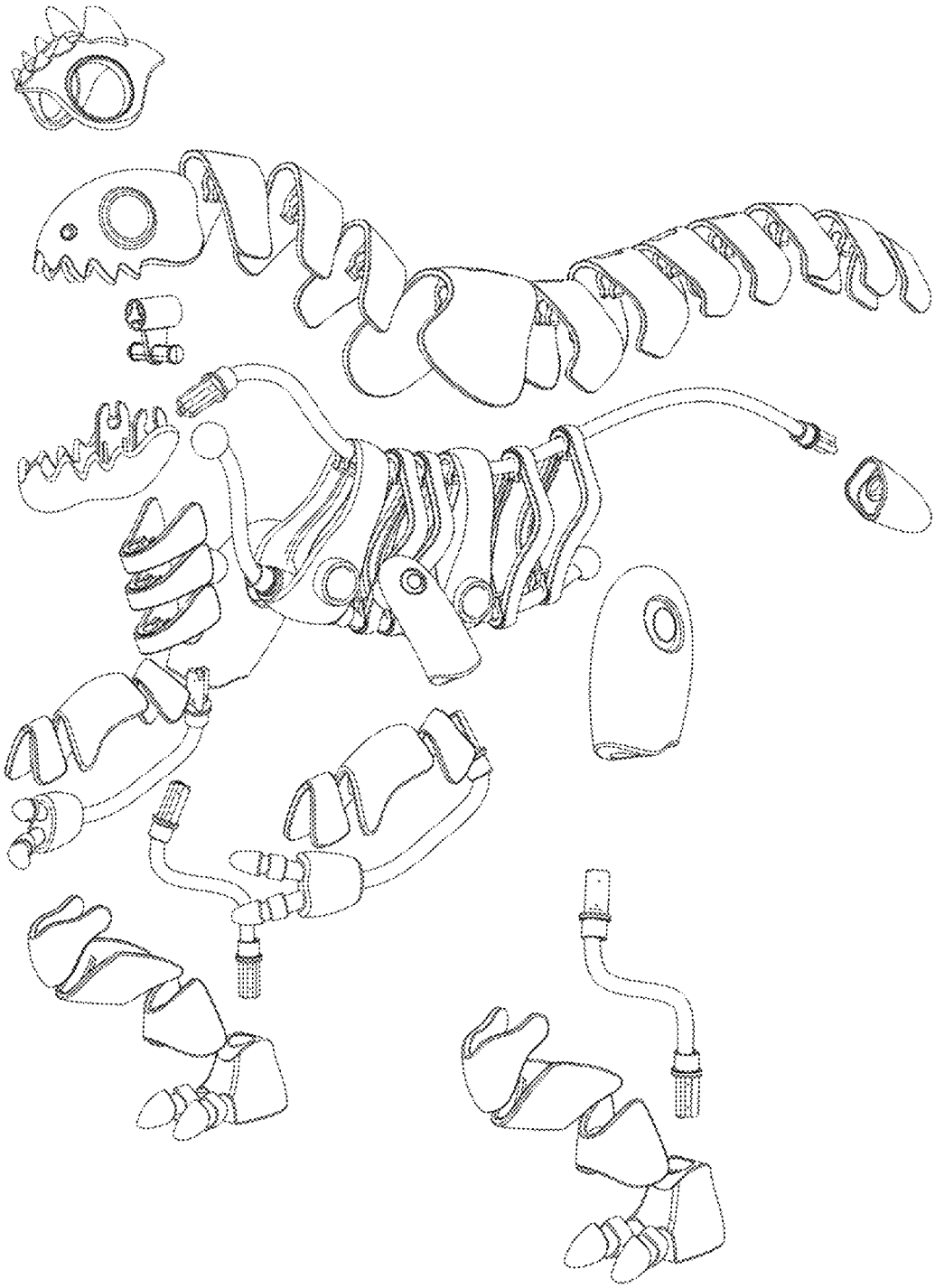
FIG. 10 shows the component parts forming a two-footed dinosaur.

FIG. 6 shows four evolution branches specified in a basic box, i.e. insects I, fish II, amphibians III, reptiles and dinosaurs IV. FIG. 7 shows a first embodiment of two possible insects. These two possible insects may be a flat insect A or a narrow insect B. FIG. 8 shows a second evolution scheme. A flounder C finally evolves into a two-footed amphibian E by way of an amphibian D. FIG. 9 shows a third evolution scheme. A narrow fish F finally evolves into a two-footed dinosaur H by way of a reptile G. FIG. 10 shows the component parts forming the two-footed dinosaur.

Figure 11:
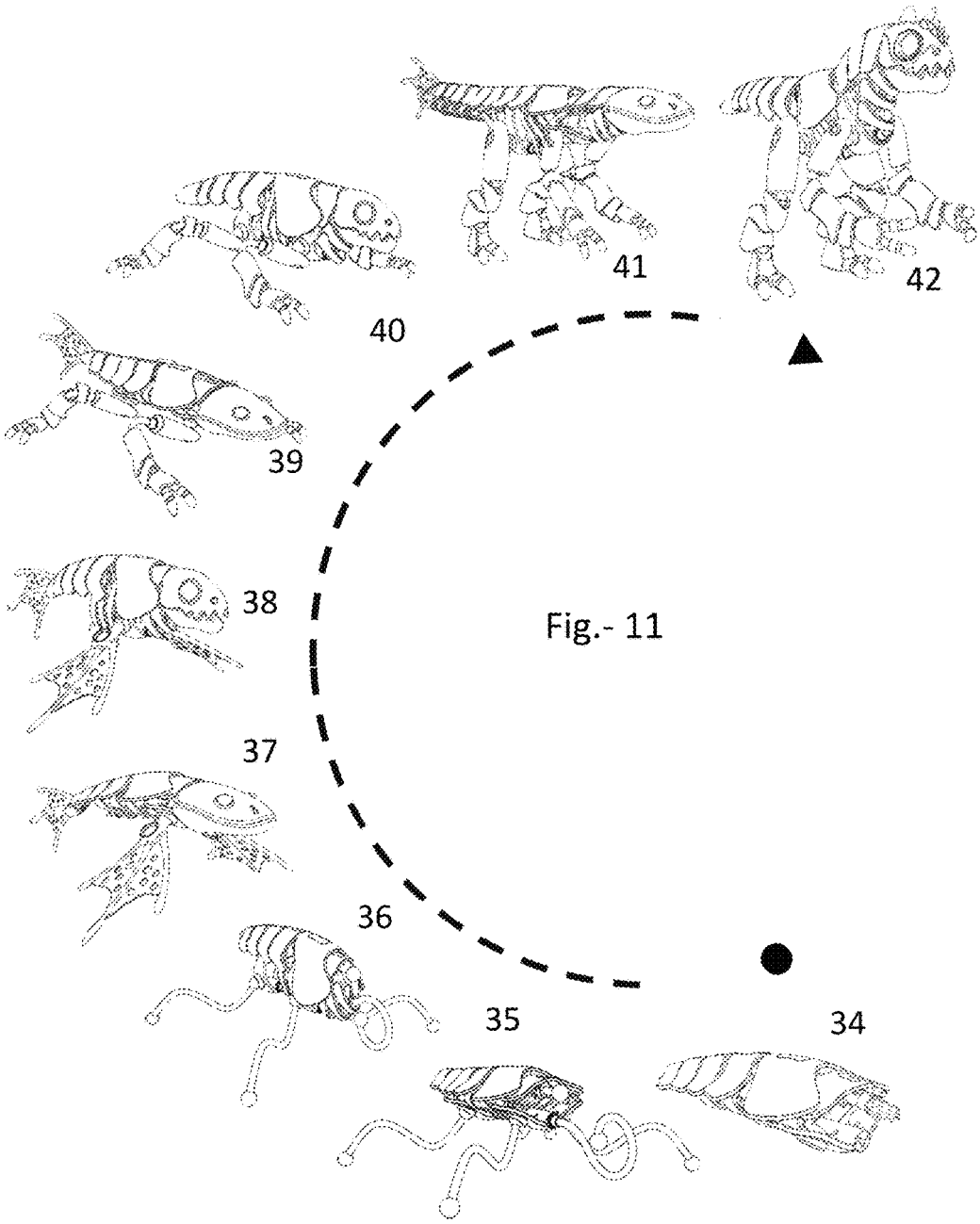
FIG. 11 is a series picture, showing a linear evolution scheme from the most basic method to the most complex method.

FIG. 11 is a series picture, showing a linear evolution scheme from the most basic method to the most complex method (34-42). These settings are suggestions for use; the user can recombine components according to his/her own preferences to construct other animals.

Figure 12:
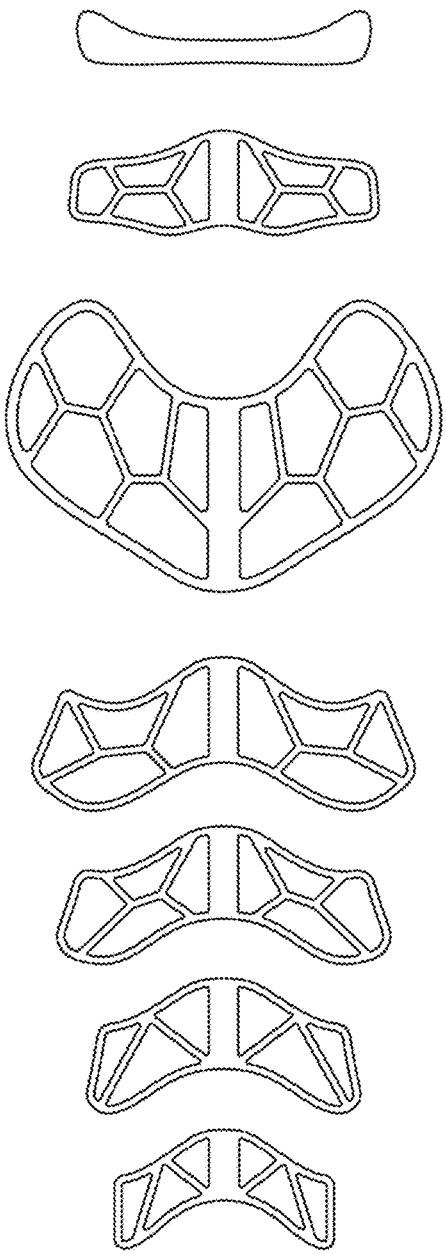
FIG. 12 shows a top view of internal arrays corresponding to each extendable section of an animal body.
Figure 13:
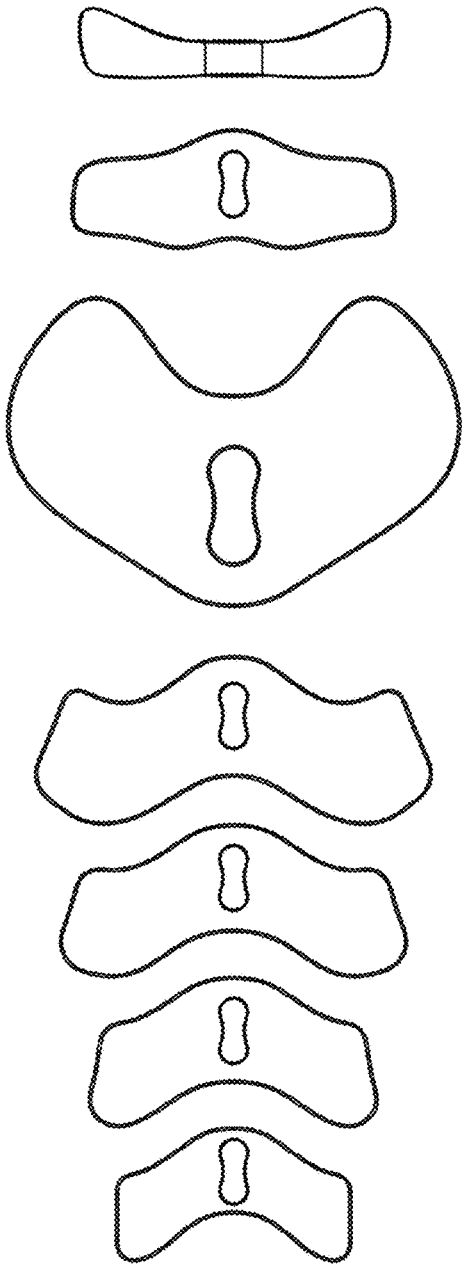
FIG. 13 shows a top view of internal arrays corresponding to each extendable section of the animal body, showing parts 8 to 14 in FIG. 4.

FIG. 12 shows a top view of internal arrays corresponding to each extendable section of an animal body. FIG. 13 shows a top view of internal arrays corresponding to each extendable section of the animal body, showing parts 8 to 14 in FIG. 4; as shown in the figure, the interior of the product is provided with completely encapsulated metal components.

Figure 14:
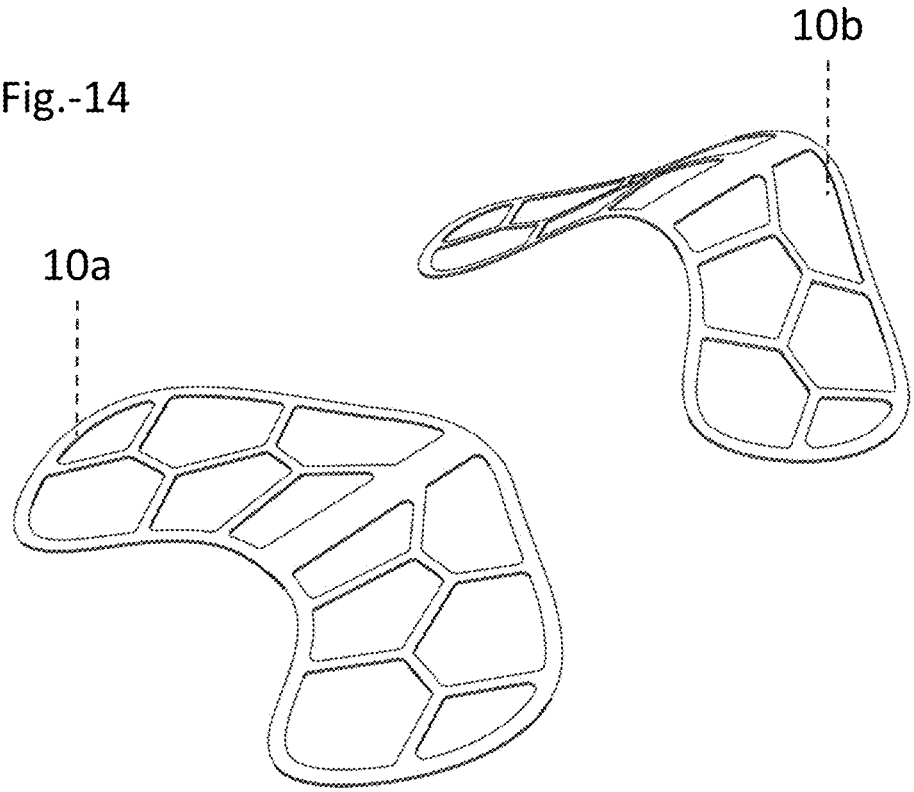
FIG. 14 shows a perspective view of an internal extension array corresponding to the body back-side part.
Figure 15:
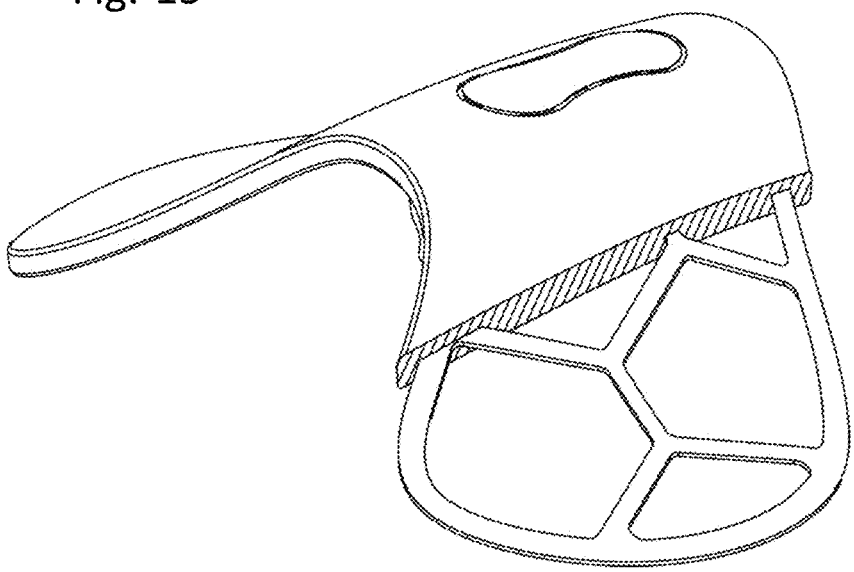
FIG. 15 shows a picture of a plastic extendable embedded array used to form the body back-side part.
Figure 16:
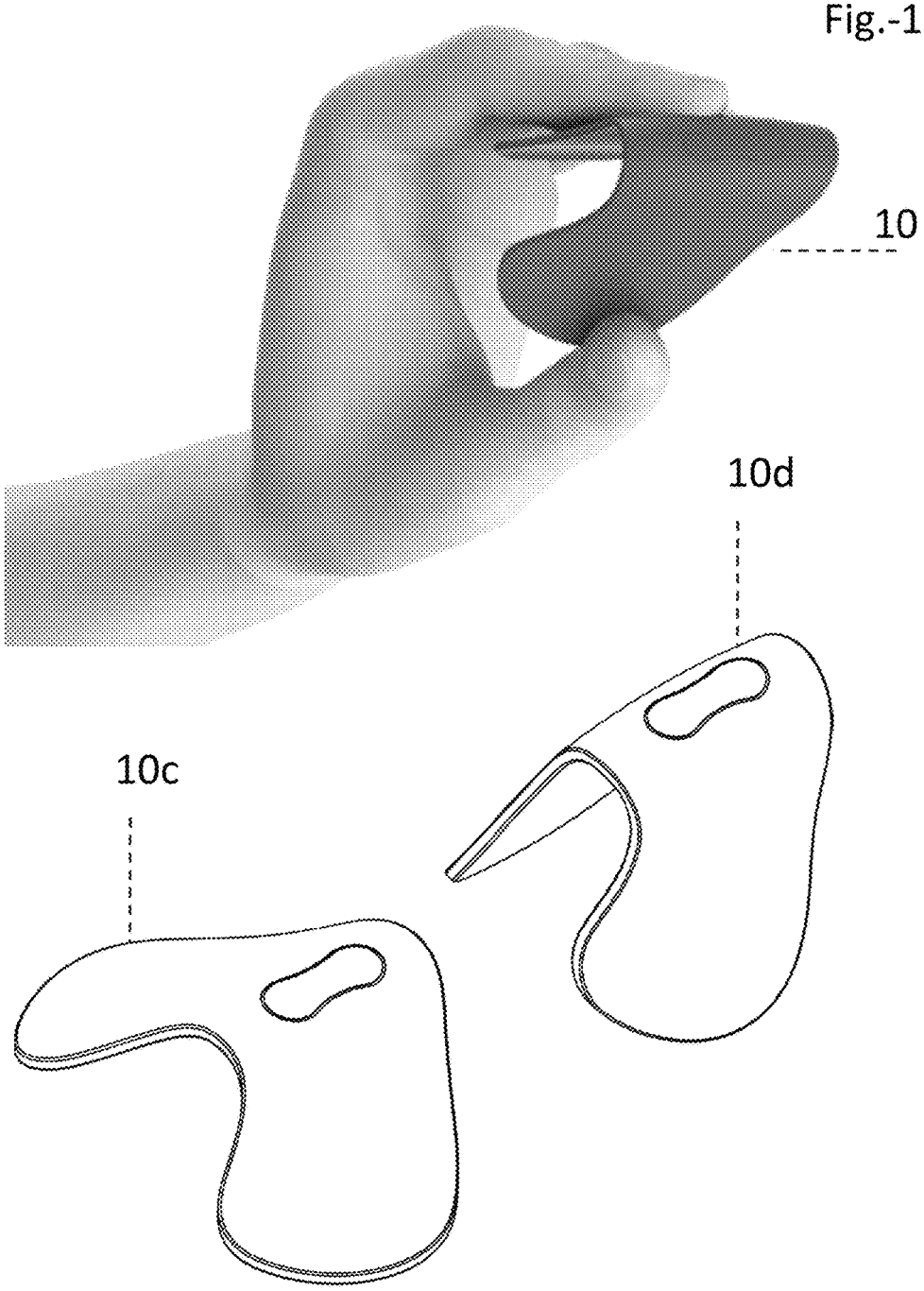
FIG. 16 shows a scale picture of the body back-side part associated with a target user, highlighting in particular the deforming ability thereof.

FIG. 14 shows a perspective view of an internal extension array corresponding to the body back-side part 10. This shows the horizontal case 10*a* and a deformed case 10*a*. FIG. 15 shows a picture of a plastic extendable embedded array used to form the body back-side part 10. FIG. 16 shows a scale picture of the body back-side part 10 associated with a target user, highlighting in particular the deforming ability thereof, and also shows perspective views of parts of the body back-side part arranged to be narrow 10*d* and flat 10*c*.

Figure 17:
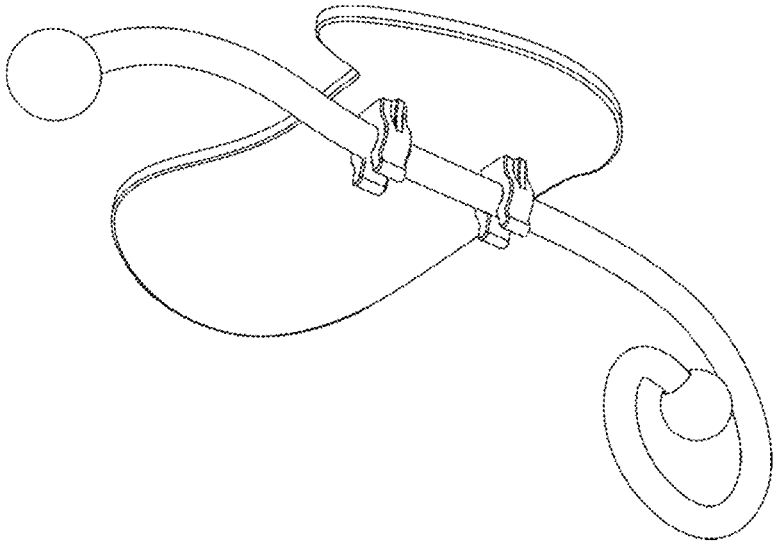
FIG. 17 shows a detailed picture of the connection between the body back-side part and the middle spherical connection extendable structural joint piece.
Figure 18:
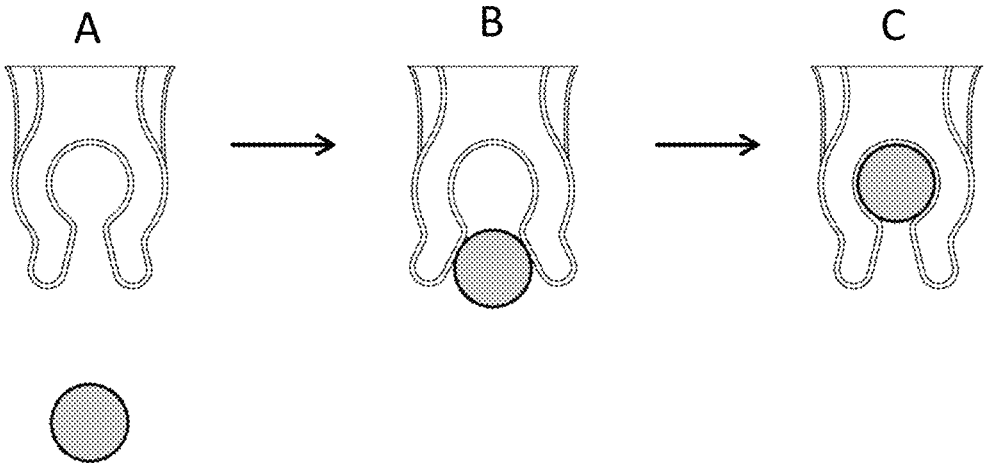
FIG. 18 shows a front view of the process of connecting the structural joint piece and the back-side part which form a basic animal body.

FIG. 17 shows a detailed picture of the connection between the body back-side part 10 and the middle spherical connection extendable structural joint piece 3. FIG. 18 shows a front view of the process of connecting the structural joint piece and the back-side part which form the body. To connect these components, in a first step (A), the structural joint piece 3 must be aligned with the center of a fixing clamp; in a second step (B), the structural joint piece 3 is pressed into the fixing clamp, so that it deforms plastically and allows a round head of the structural joint piece 3 to pass through; in a third step (C), the structural joint piece completely enters the center of the fixing clamp, completing the fixing of the components.

Figure 19:
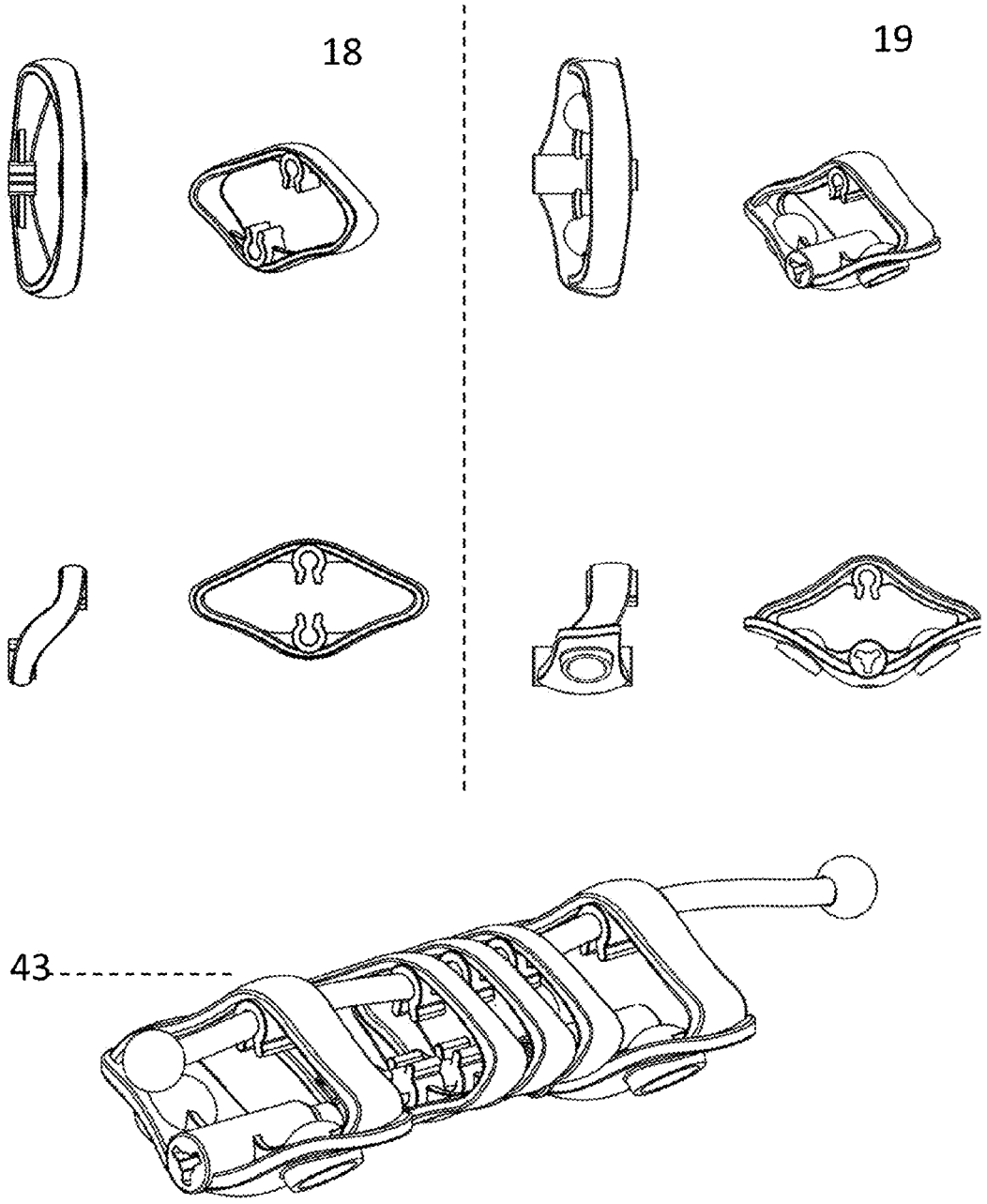
FIG. 19 shows overall and perspective views of the flat rib, overall and perspective views of the flat limb connection main body, and a perspective view of basic components of a flat animal body.

FIG. 19 shows overall and perspective views of the flat rib 18, overall and perspective views of the flat limb connection main body 19, and a perspective view of basic components of a flat animal body 43.

Figure 20:
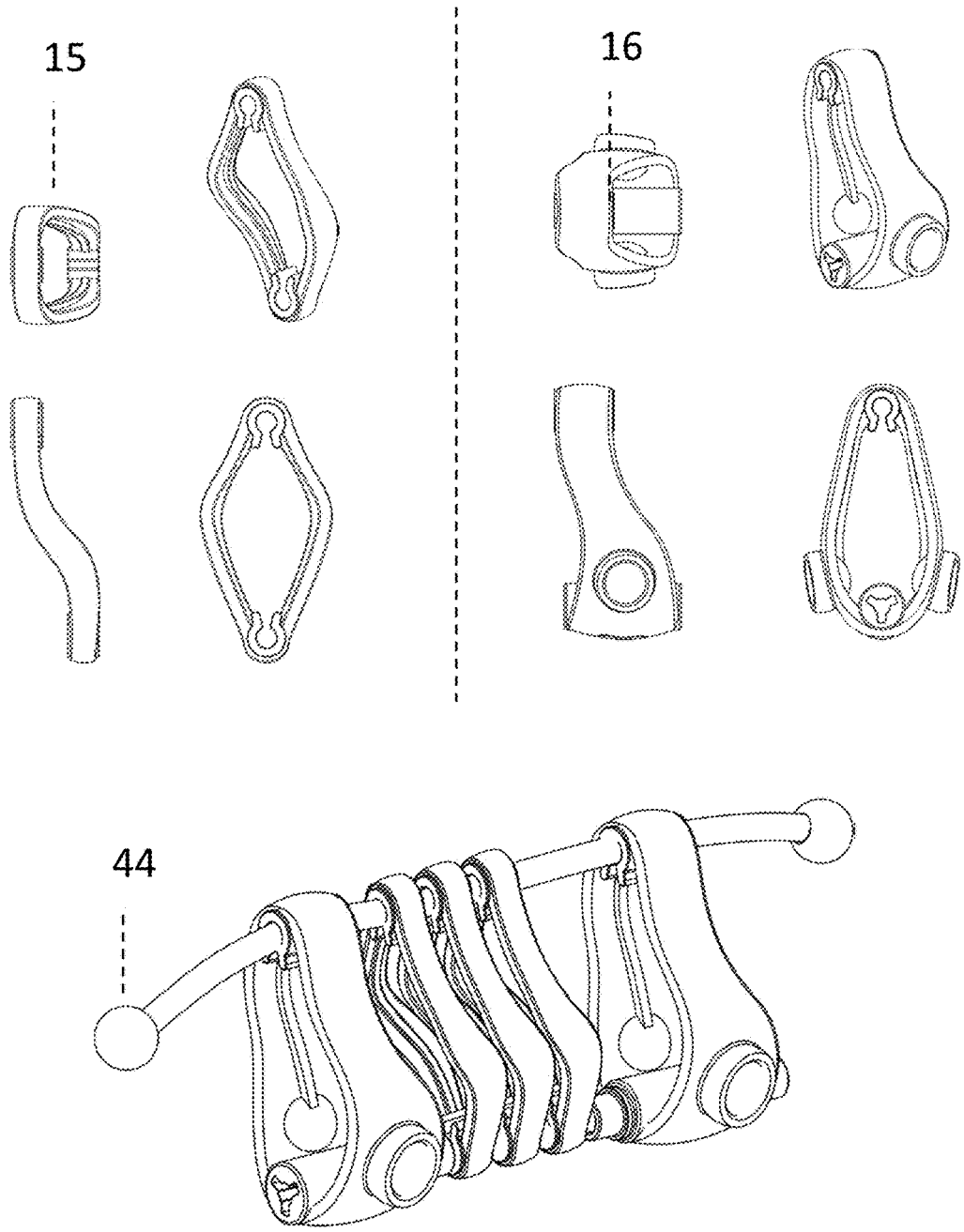
FIG. 20 shows and illustrates overall and perspective views of the narrow rib, overall and perspective views of the narrow limb connection main body, and a perspective view of basic components of a narrow animal body.

FIG. 20 shows and illustrates overall and perspective views of the narrow rib 15, overall and perspective views of the narrow limb connection main body 16, and a perspective view of basic components of a narrow animal body 44.

Figure 21:
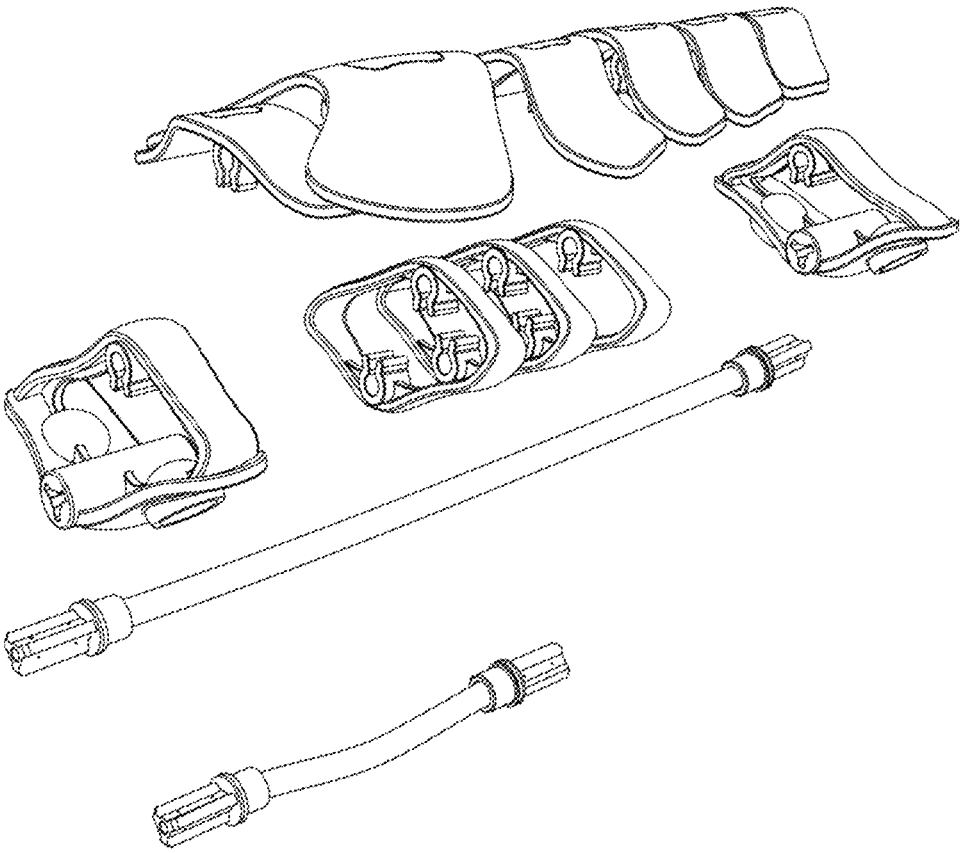
FIG. 21 shows a final component picture of a basic animal body in a flat, straight arrangement.
Figure 22:
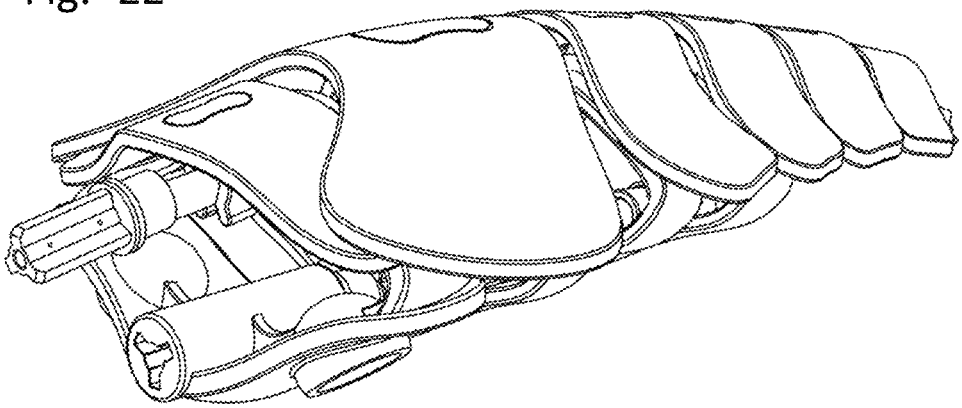
FIG. 22 shows a picture of the basic animal body in the flat, straight arrangement.

FIG. 21 shows a final component picture of a basic animal body in a flat, straight arrangement. A flat animal body region (flat ribs and flat limb connecting main bodies) is used in the manner illustrated in FIG. 19. FIG. 22 shows a picture of the basic animal body in the flat, straight arrangement.

FIG. 23 shows a side section of a round structural joint rib eye, a side view of the exterior of a round structural joint piece 48, and a structural joint piece 3 or 6 associated with a hand. Details of a steel wire 46 having an extendable property piece, a steel wire plastic coating 45 and a spherical connection member 47 are shown. Details of a structural joint 49 connected to a basic animal body are shown.

FIG. 24 shows a side section of a straight connection structural joint piece, and a side view of the outside of a straight connection structural joint piece sheet 53. Details of a steel wire 51 having an extendable property piece, a steel wire plastic coating 52 and a straight connection piece 50 are shown.

Figure 25:
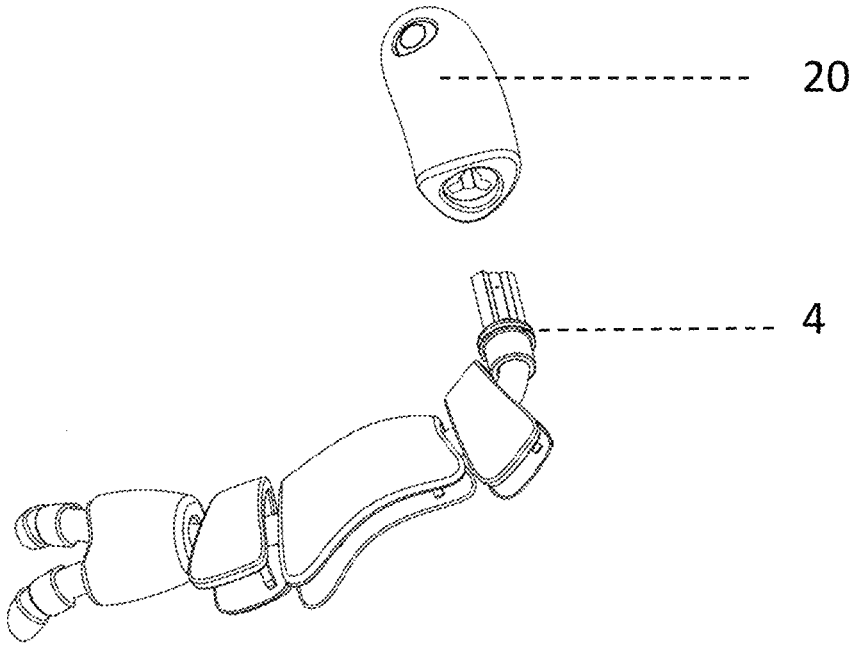
FIG. 25 shows the connection between the hand structural joint piece and the arm part.

FIG. 25 shows the connection between the hand structural joint piece 4 and the arm part 20.

Figure 26:
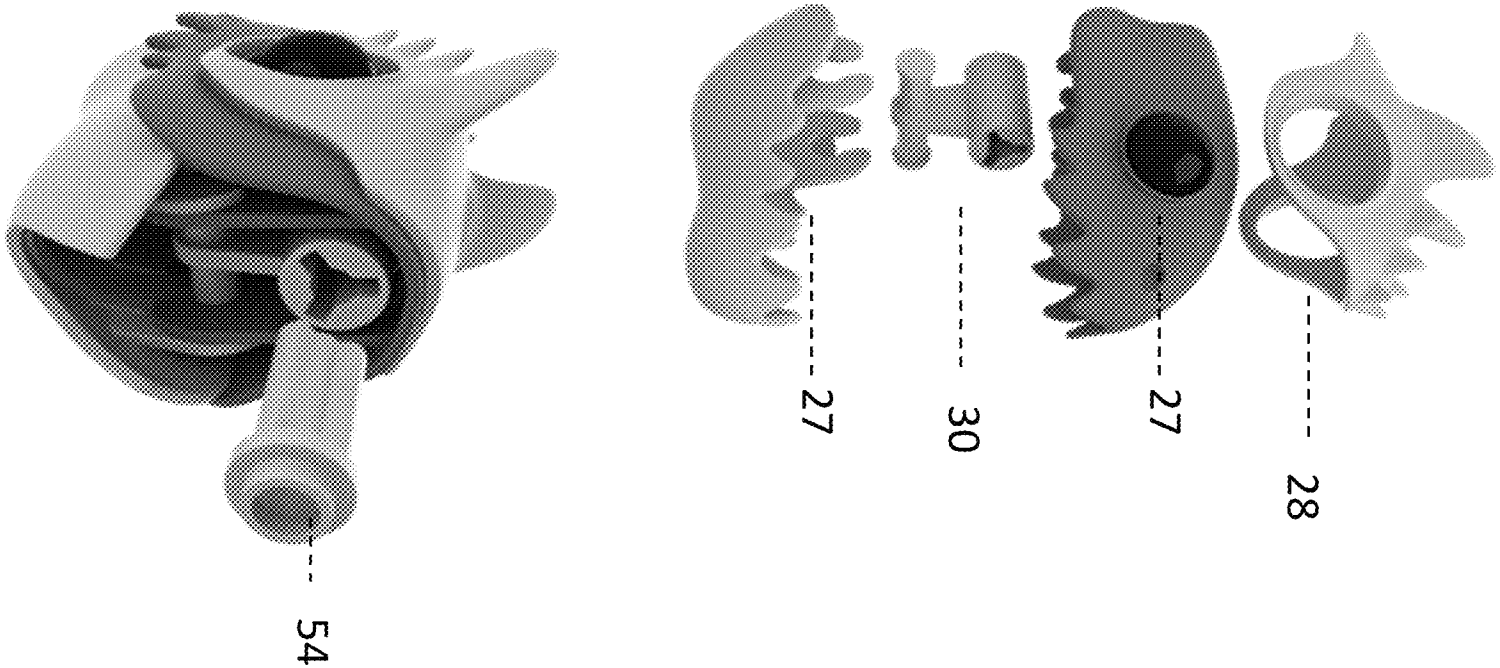
FIG. 26 shows the components which form the reptile head part in FIG. 5.

FIG. 26 shows the components which form the reptile head part in FIG. 5, comprising: the crest 28, an upper skull 27, the component 30 for connecting the head and a lower jaw 27. Details of a connection 54 between the head and a straight connection structural joint piece are illustrated.

Figure 27:
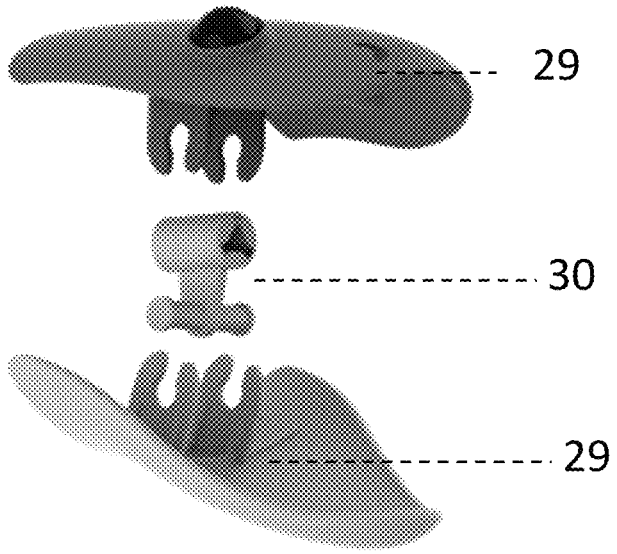
FIG. 27 shows the components which form the fish head part in FIG. 5.
Figure 27:
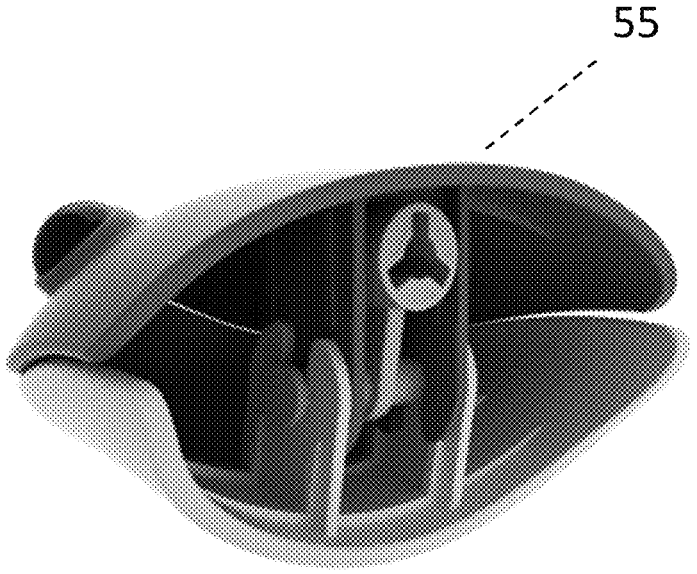

FIG. 27 shows the components which form the fish head part in FIG. 5.

Figure 28:
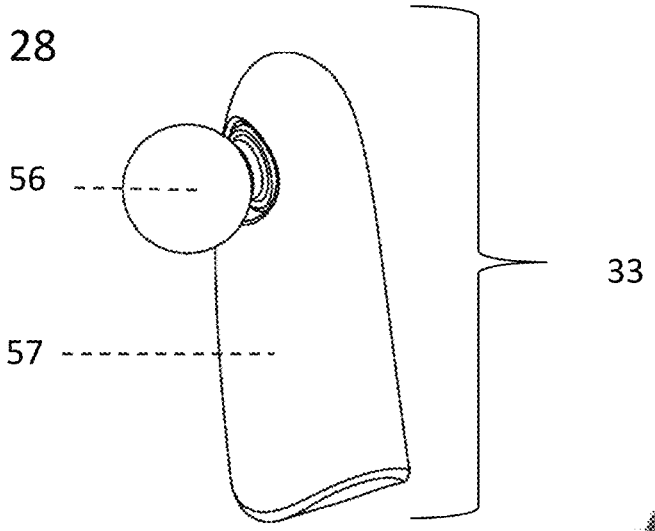
FIG. 28 shows the components which form an upper arm part.

FIG. 28 shows the components which form an upper arm 33 part. Firstly there is an animal body part 57 of the component, as well as a spherical connector 56 which fixes the component to the narrow limb connection main body 16 and the flat limb connection main body 19.

Figure 29:
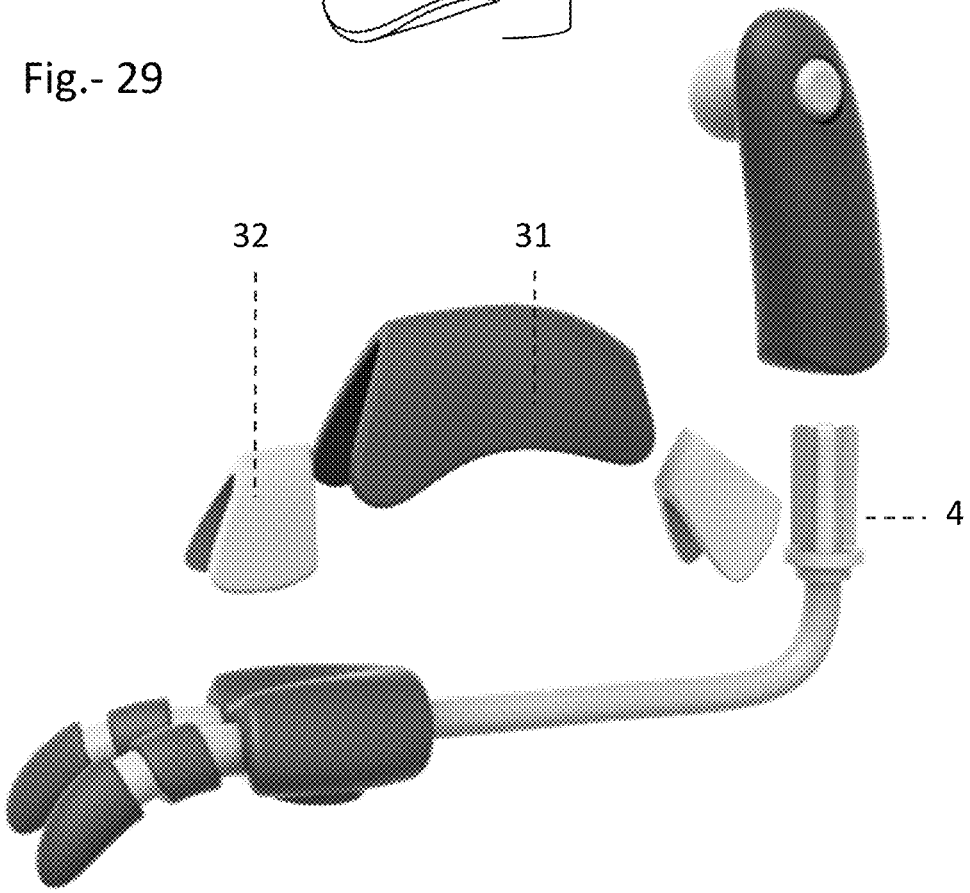
FIG. 29 shows the components which form an entire upper limb.

FIG. 29 shows the components which form an entire upper limb. The components comprise: the extendable hand structural joint piece 4, the elbow and wrist components 32 and the front arm 31.

Figure 30:
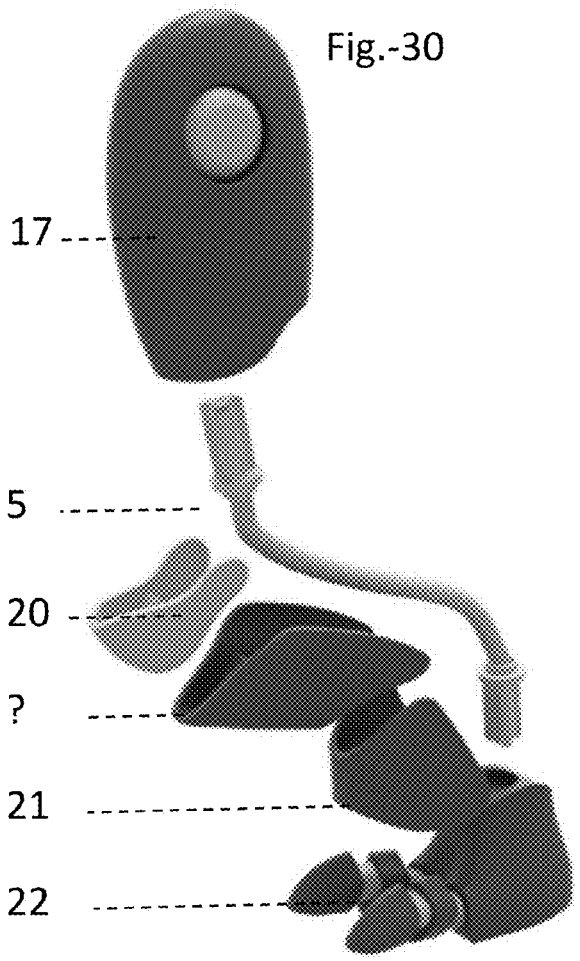
FIG. 30 shows a picture of all components of a lower limb.
Figure 31:
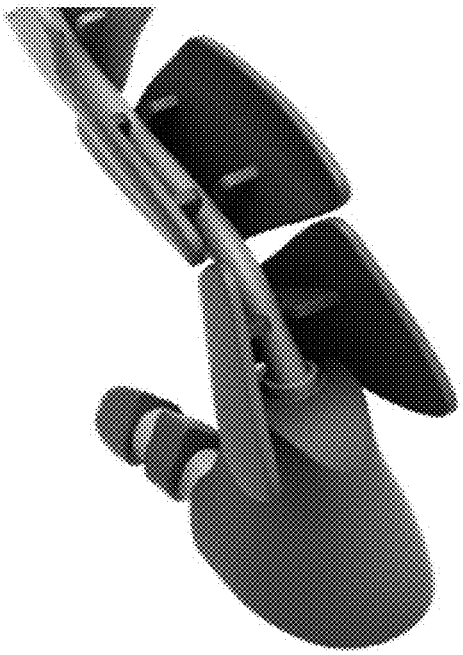
FIG. 31 shows in detail a rear view of an assembled lower limb.

FIG. 30 shows a picture of all components of a lower limb. The components comprise a thigh 17, a straight connection structural joint piece 5, a knee 20, a shin 24, an ankle 21 and a foot 22. Details of the pressure joint situation of components between the lower limb and structural joint piece are shown. FIG. 31 shows in detail a rear view of an assembled lower limb.

Figure 32:
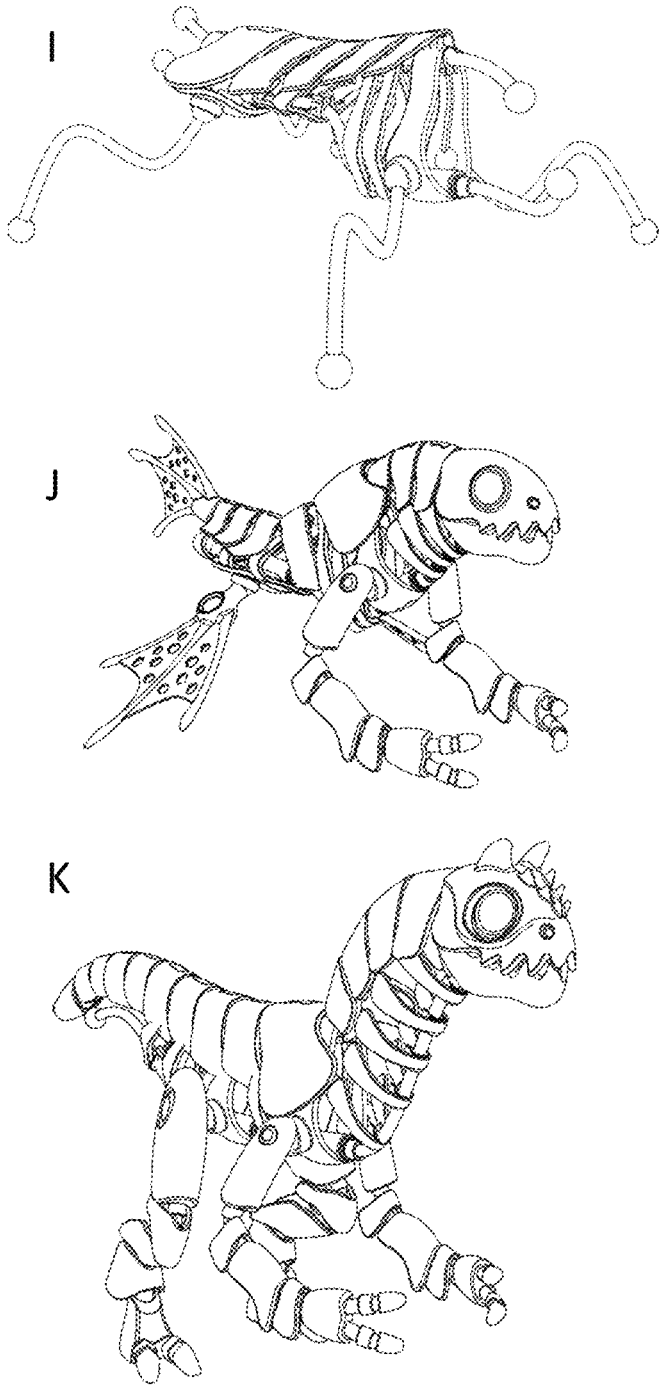
FIG. 32 shows some possible changes after replacing product components, and adding components in a flat arrangement which have perpendicular components.

FIG. 32 shows some possible changes after replacing product components, and adding components in a flat arrangement which have perpendicular components, e.g. insect I; adding components of a different animal J; or reusing an animal body module to obtain a long-necked or long-tailed animal K.

Figure 33:
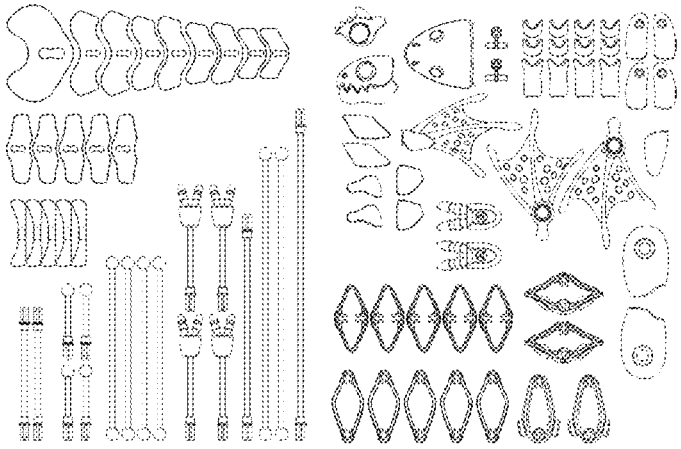
FIG. 33 shows a view from above of all component parts forming the product and summarizes the assembly possibilities.
Figure 33:
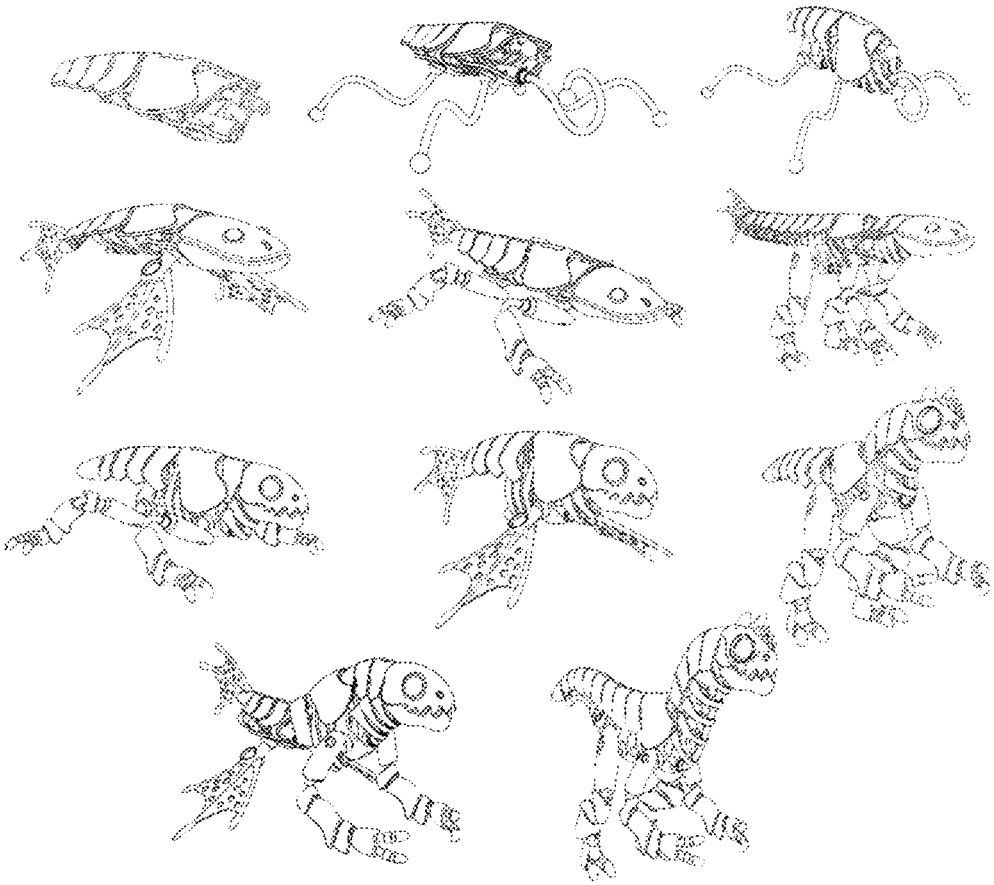

FIG. 33 shows a view from above of all component parts forming the product and summarizes the assembly possibilities.

Figure 34:
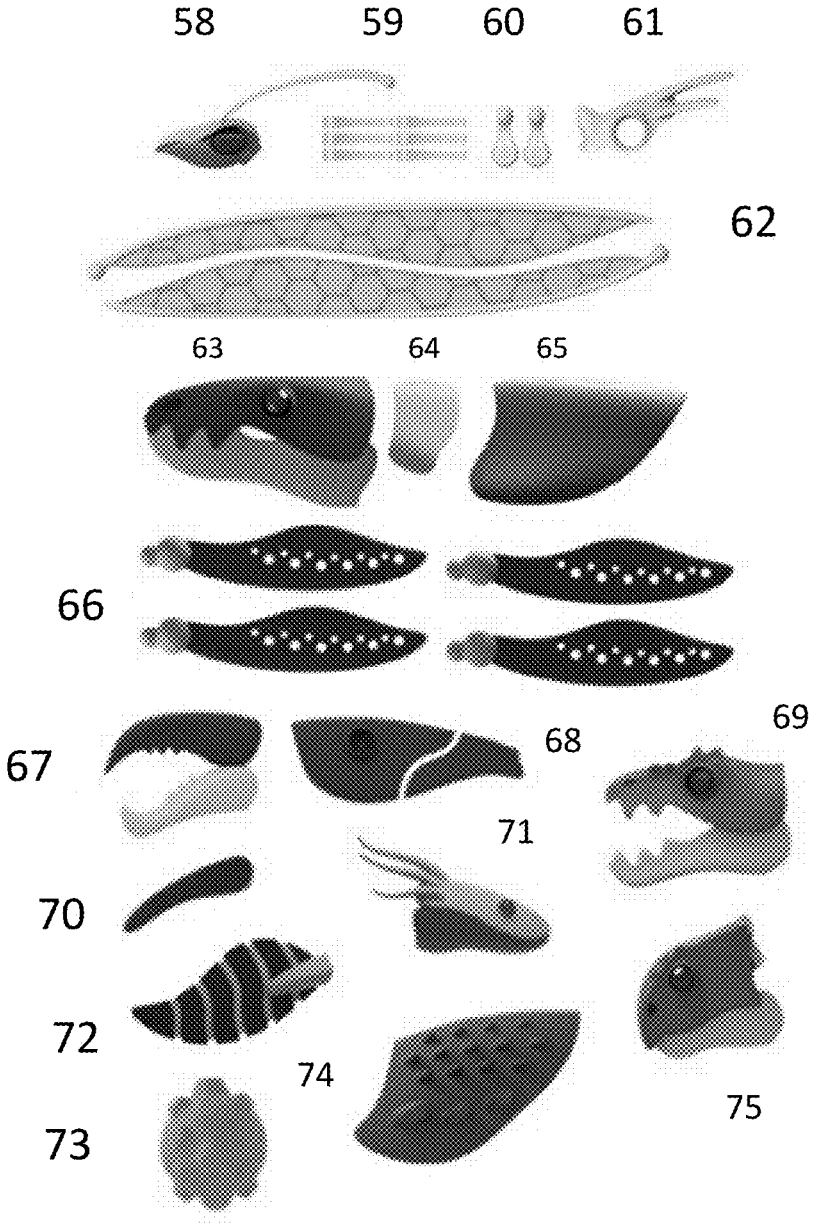
FIG. 34 shows certain parts of different expansion packs.

FIG. 34 shows certain parts of different expansion packs. They comprise special animal body modules and specialized mechanisms, such as: a large neck module 64; a large animal body module 65; an animal body module 68 with a spherical back-side shaft coupling; an ankylosaurus large animal body module 74; an insect head 58; a lizard head 63; a jaw pincer head 68; a large allosaurus head 69; a salamander head 71; an ankylosaurus head 75; a dragon crest 61; limbs: thin fin pieces 66; an insect leg 70; tail piece: a thin fish tail 72; an ankylosaurus tail 73; wings 62; long thin claws 59; and thick claws 60, etc.

Figure 35:
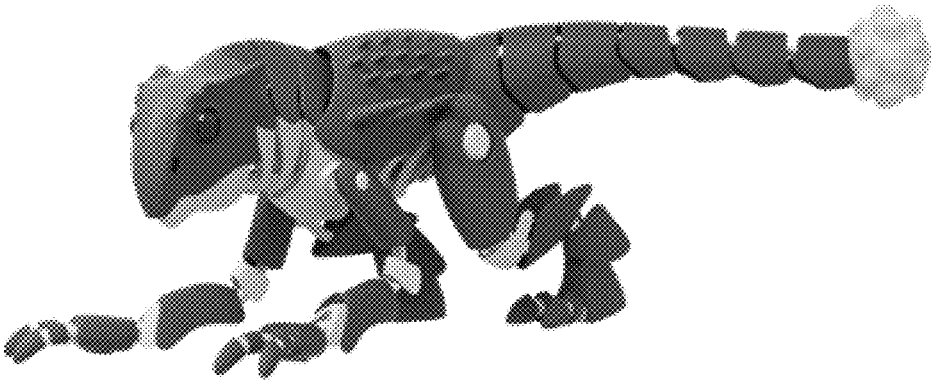
FIG. 35 shows a picture of an ankylosaurus from a dinosaur expansion pack.
Figure 36:
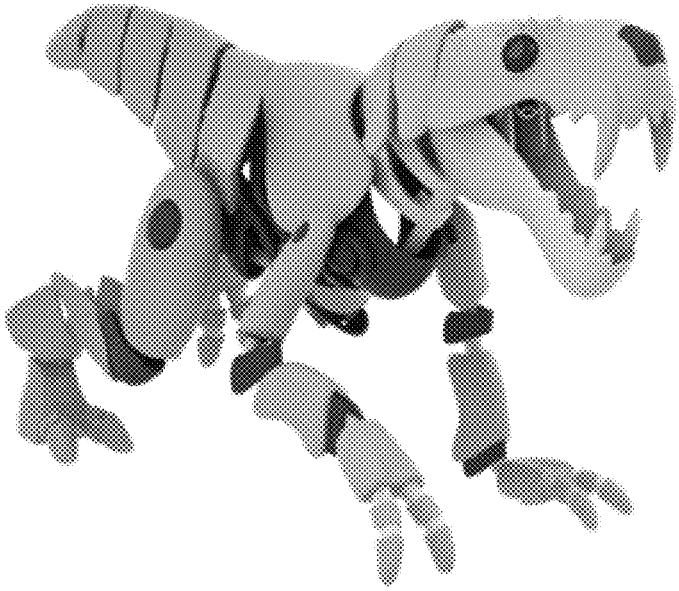
FIG. 36 shows a picture of a dinosaur in the theropod class from a dinosaur expansion pack.
Figure 41:
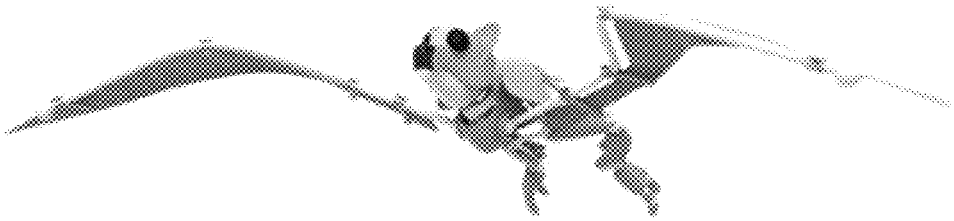
FIG. 41 shows an image of a bat from a mammal expansion pack.
Figure 42:
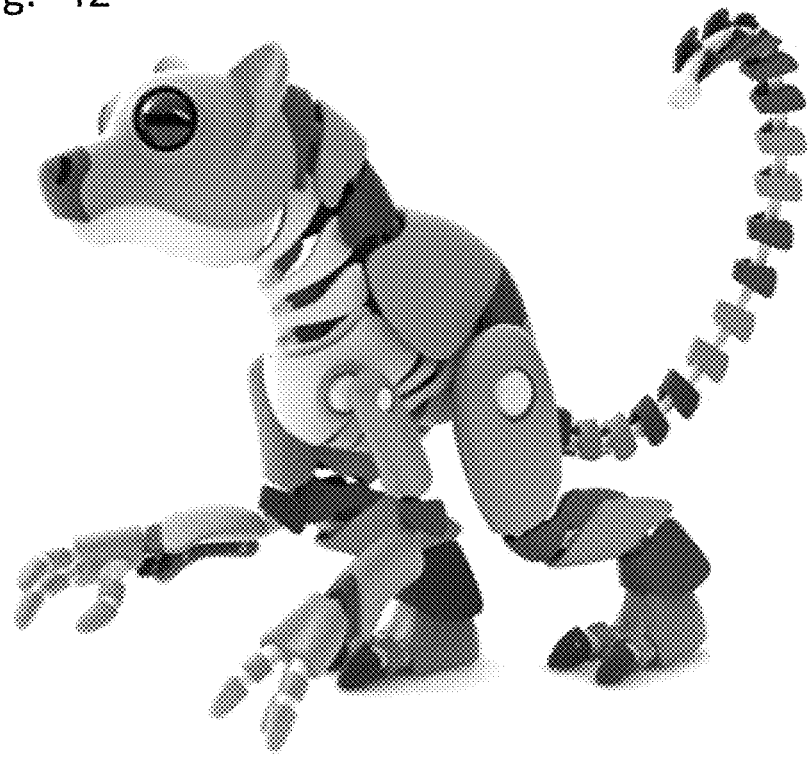
FIG. 42 shows a picture of a lemur from a mammal expansion pack.
Figure 43:
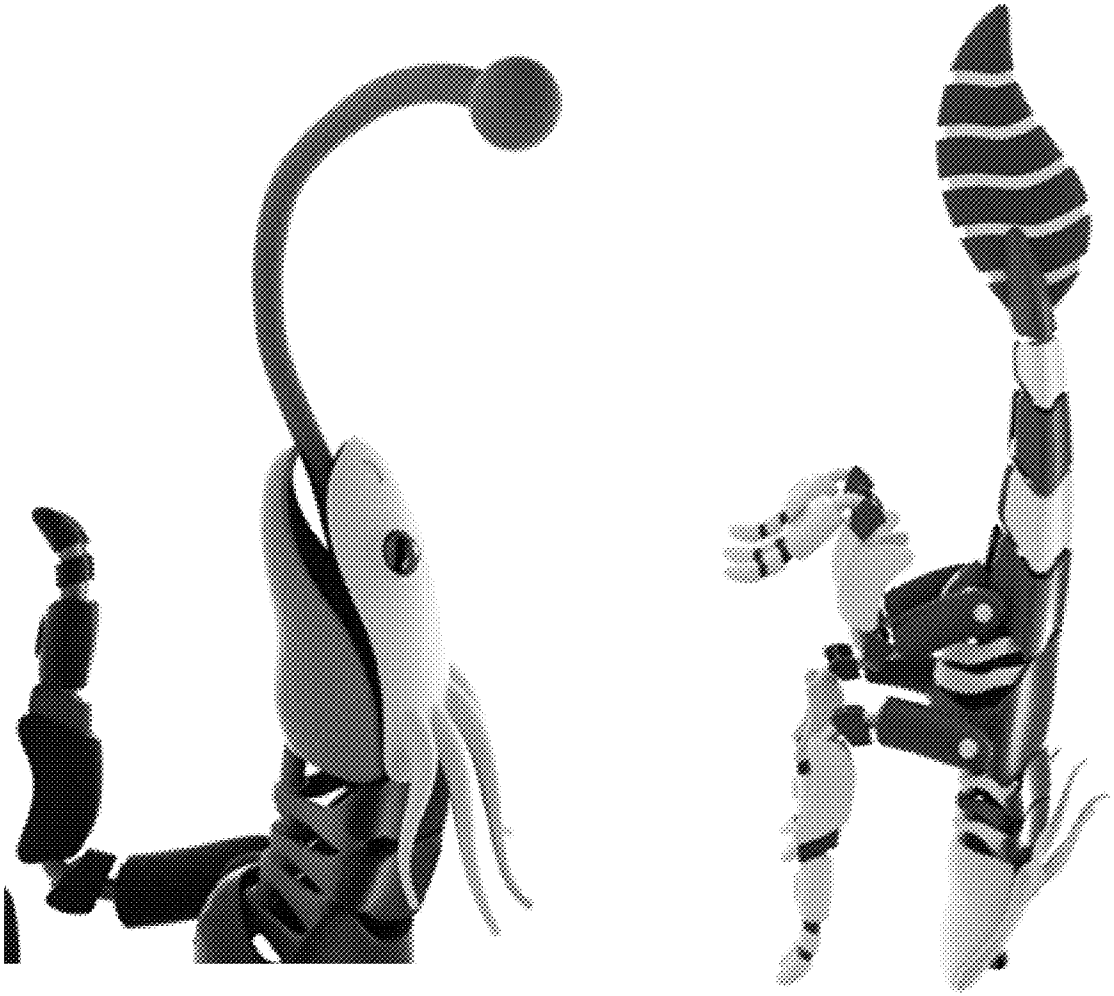
FIG. 43 shows a picture of a salamander from an amphibian expansion pack, as well as an alternative scheme in which an extendable structural joint piece is used as a tongue.
Figure 44:
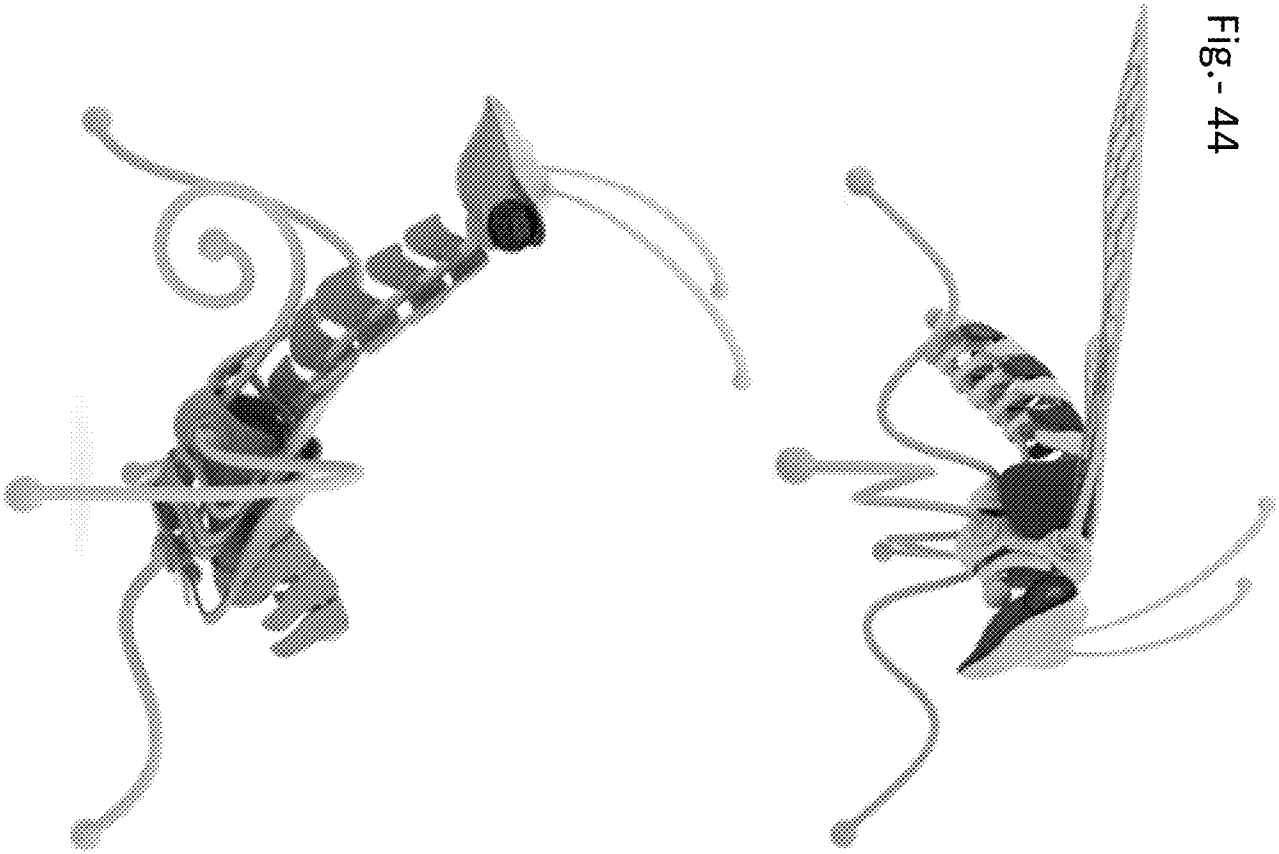
FIG. 44 shows in detail two possible insects from a basic pack: a wasp and a mantis.

FIG. 35 shows a picture of an ankylosaurus from a dinosaur expansion pack. FIG. 36 shows a picture of a dinosaur in the theropod class from a dinosaur expansion pack. FIG. 37 shows a picture of a pliosaurus from a marine reptile expansion pack. FIG. 38 shows a picture of a plesiosaurus from a marine reptile expansion pack. FIG. 39 shows a picture of a certain pterosaur from an expansion pack of the same name. FIG. 40 shows a picture of a certain pterosaur from an expansion pack of the same name, showing in detail a pressure-bearing shaft coupling. FIG. 41 shows an image of a bat from a mammal expansion pack. FIG. 42 shows a picture of a lemur from a mammal expansion pack, giving a modular example in which elbow and wrist components 32 are used as a tail. FIG. 43 shows a picture of a salamander from an amphibian expansion pack, as well as an alternative scheme in which an extendable structural joint piece is used as a tongue. FIG. 44 shows in detail two possible insects from a basic pack: a wasp and a mantis.

FIG. 45 shows a picture of "suction pad" accessories for the regions of the four limbs. This component includes a suction pad 76, a pivot point hinge piece 77 and an extendable short mixed connection structural joint piece 2. FIG. 46 shows a view of an accessory installed on a front limb component; an ankle joint 21 can be seen.

Figure 47:
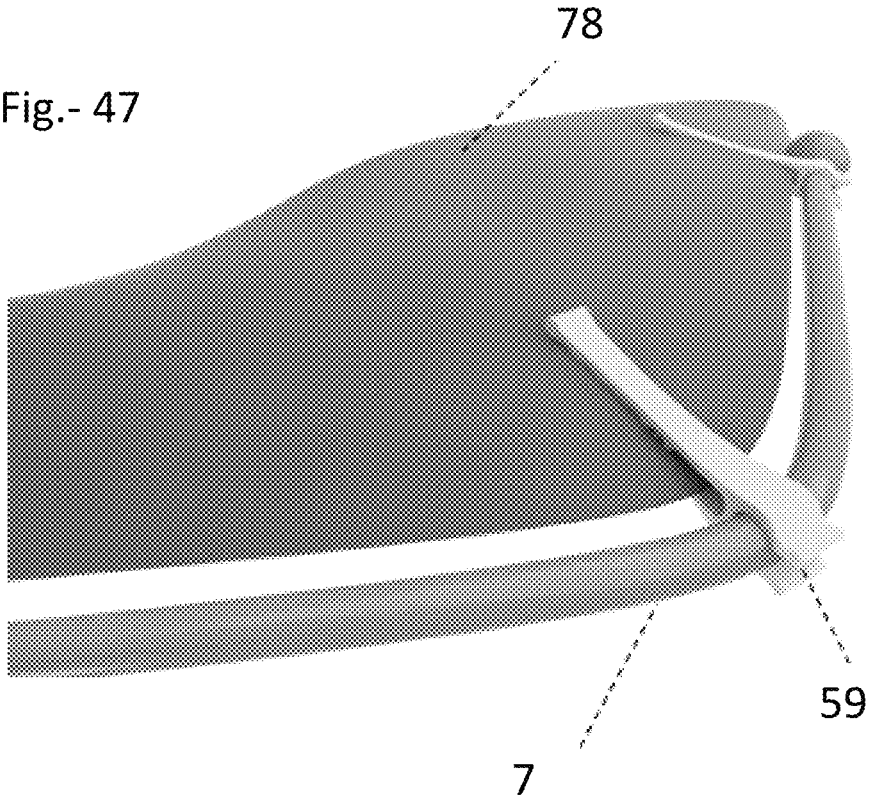
FIG. 47 shows a picture of an "elongated claw" accessory for the four limbs.
Figure 48:
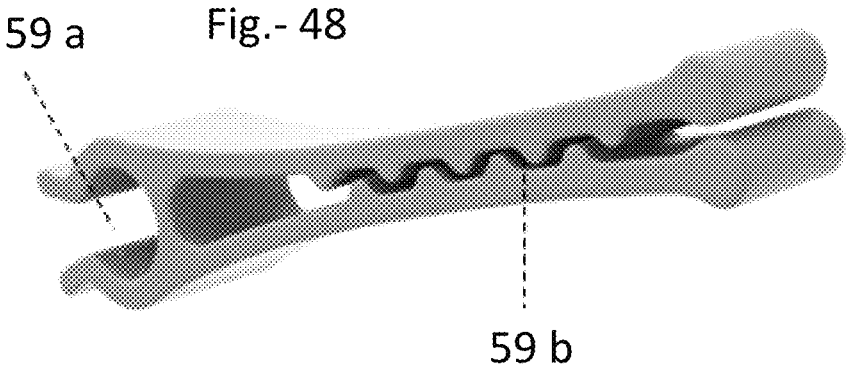
FIG. 48 shows a view of the long thin fixing claw.

FIG. 47 shows a picture of an "elongated claw" 59 accessory for the four limbs. The accessory includes a membrane 78 customized for the user and a long thin fixing claw 59, installed on an extendable structural joint piece (1, 2, 3, 5, 6 or 7). FIG. 48 shows a view of the long thin fixing claw, showing in detail the point where the fixing claw 59 with teeth 59*b* is anchored to the structural joint piece.

Figure 49:
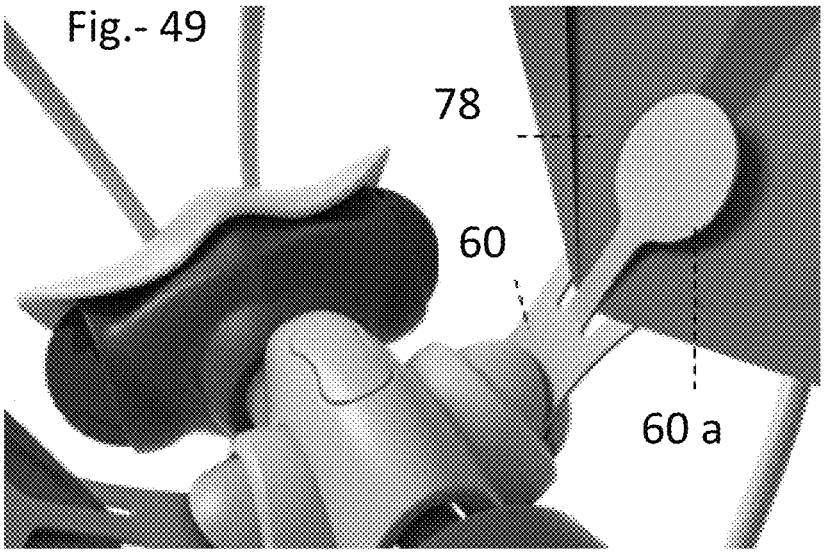
FIG. 49 shows a picture of a "thick claw" accessory for the four limbs.

FIG. 49 shows a picture of a "thick claw" 60 accessory for the four limbs. The accessory includes a membrane 78 customized for the user and a thick claw 60 fastened to a spherical hinge component.

Figure 50:
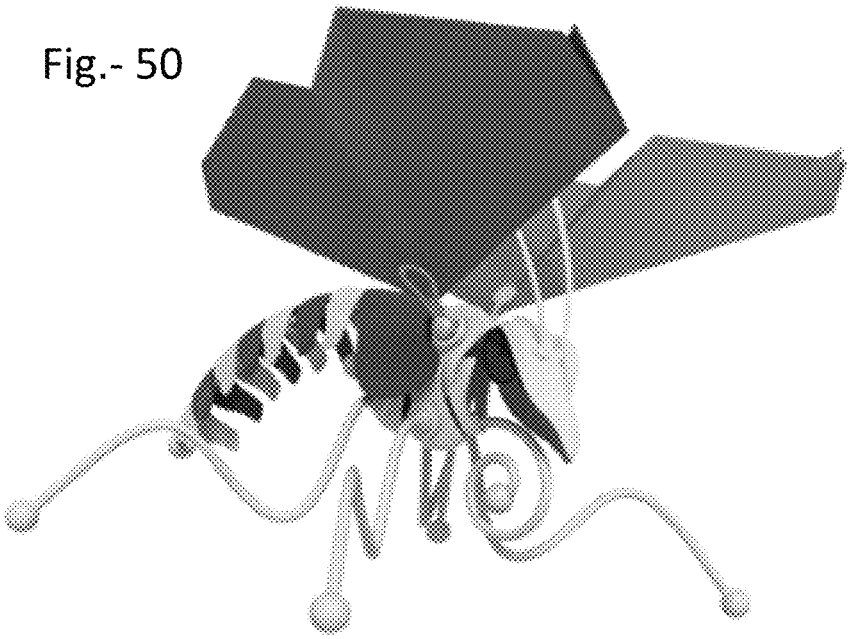
FIG. 50 shows a view of an insect that is changed from a "wasp" to a "butterfly" by means of the accessory.

FIG. 50 shows a view of an insect that is changed from a "wasp" to a "butterfly" by means of the accessory.

Figure 51:
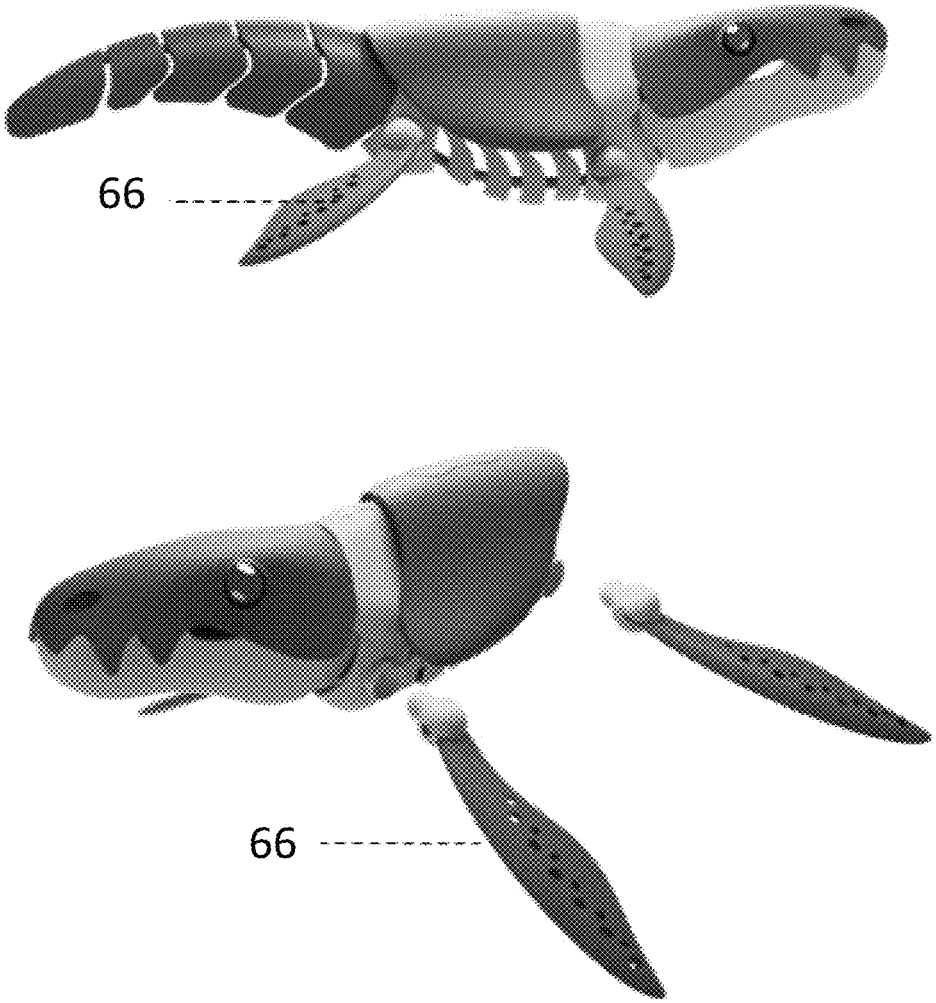
FIG. 51 shows a picture of a corresponding marine reptile and elongated fin spherical components thereof.

FIG. 51 shows a picture of a corresponding marine reptile and elongated fin spherical components 66 thereof.

FIG. 52 shows a picture of a summary of various configuration possibilities obtained by summarizing the basic animal body in FIG. 22 and the components in FIGS. 4, 5 and 34.

A part corresponding to an animal body is a flat component as far as the user is concerned, and contains an extendable rigid array (FIG. 12). A flexible polymer base material encapsulating the component enables each piece therein to extend (FIG. 13).

The extendability of each component maximizes the configuration possibilities of the assembly-type evolutionary game system, but the number of extendable components that can be used at the same time is fixed. However, the game experience can be enriched without an excessive increase in cost and production complexity. Extendable components can be increased in size during assembly. The user must pay attention to the mating thereof, as well as details of coordination and symmetry, to give the assembly process (FIGS. 19 and 20) greater depth.

In FIG. 19, a component corresponding to the flat limb connection main body is connected to a top structural joint piece (see FIG. 4, labels 1 to 7); in such a combination a "clamp" is connected around the top structural joint piece, similarly to the manner illustrated in FIG. 18. At the top, the structural joint piece serves as a "skeleton", providing support for the remaining components; in this case, the ribs and the flat limb connection main bodies 19 for the four limbs are as shown in FIG. 5. To strengthen this structure, the straight connection structural joint piece 1, 5 or 7 in FIG. 4 is positioned to connect two animal body components, and to prevent the components surrounding the structural joint piece from rotating around the latter. The flat ribs 18 in FIG. 5 are used as additional strengthening material, reinforcing the structure and providing support for the body back-side parts 9 to 14 in FIG. 4.

With regard to the construction of the animal body of each animal, each flat component has one or more pincer-like components, protruding perpendicularly from a surface of the component (FIG. 18). A round opening is provided at the center of a perpendicular member, the material of the round opening having the same elasticity and geometric shape, so that the round structural joint piece 48 in the middle (FIG. 23) can be closed up completely.

This round structural joint piece 48 in the middle (FIG. 23) can be manipulated to create different shapes. The elements or components in FIG. 13 signify an animal body flat back, i.e. parts positioned on a "skeleton", which are able to form a back-side part of an animal (FIG. 21). A spinal column is supported by two support pieces, which are called limb connection animal bodies, mainly because at the bottom they have a pair of female spherical shaft couplings used for receiving and articulating each of the animal's four limbs. These animal bodies may be in a horizontal direction (43) or a perpendicular direction (44), or of mixed type (I). A connection mechanism, together with the flat ribs 18 and the perpendicular narrow ribs 15, provides additional support, as well as providing rigidity for the structure. A pincer-like shaft coupling is connected in a free space between back-side and abdominal-side components, thereby creating a cylinder, with openings left at the two ends. This unit is called a "base body" (FIG. 22).

In FIG. 13, the components which form the base body can be seen, being rounded, but the overall geometric shape thereof is relatively simple. This enables the user to freely reallocate the positions and functions of these components.

When components are connected to extendable joint pieces, spaces must be left; these spaces are all hinge points, each being able to change its direction with respect to another point. The "flat" arrangement (43) is more conducive to perpendicular movement of components, whereas the "narrow" arrangement (44) is more conducive to horizontal movement. The feasibility of free movement will be directly proportional to the space between components. In addition to translational motion, components can also rotate around the support or slide thereon, be pieced together and reinforce the edges of each structural element.

The characteristics of the components and the assembly methods thereof divide the toy into animal body sections and different components. This enables the user to simultaneously create a vertebrate (FIGS. 8 and 9) and an arthropod (FIG. 7), allowing the use of the same components (FIGS. 4 and 5) to be more satisfying.

The base body formed (FIG. 22) is ready to accept various components such as a head, four limbs and a tail piece, so that it conforms to the aesthetic configuration requirements of the client.

A first type of assembly refers to male/female connectors, wherein a spherical joint is pressed into a hemispherical connector, and is able to freely rotate (FIG. 23). The male connector connection is pressed into a connection point located on the horizontal connection animal body 19 and the perpendicular connection animal body 16.

A second assembly method can be seen in FIG. 25; this is also a male/female connector system, but in this case, the connector has no articulation. A triple-equidistant shaft is arranged radially, and enters a narrow cavity directly; material is pulled to set the components in place (FIG. 24).

In FIGS. 26 and 27, some animal heads can be seen, on which are jaws 27 and 29, which can open or close as a hinge is employed. The internal structure of the head and jaw is perpendicular, and in the center has a horseshoe-shaped opening, allowing a shaft to be pressed in, and a head component (30) which rotates two around the shaft. A removable "crest" or cluster of flexible material can be positioned on the head (marked 28 in FIG. 5), and must be pressed on tightly; the objective of the crest is, without altering the overall component, to alter the appearance thereof.

The four limbs are elements which exhibit complexity according to the user's objective. In embodiments A and B in FIG. 7, it can be seen that in certain cases, a spherical connection structural joint piece (marked 3 and 6 in FIG. 4) can be used. This only requires the component to be connected to the base body, and the desired posture to be made; this is an especially effective method of simulating four legs of an insect.

In cases where greater precision is desired, various designs specifically for this job may be used. These components not only increase complexity while meeting the volume requirements of small limbs, but can also be used to define specific hinge points in order to more accurately simulate bone-muscle in the structure of a vertebrate. Components which form upper limbs are explained below.

In certain cases—wing piece components (schemes C, D and E in FIG. 8), (scheme F in FIG. 9) or wings, four limbs in FIG. 44—the component is formed of a single-piece hard plastic component, connected by a male/female spherical engagement and adjusted by applying pressure.

Arms (marked 33 in FIG. 5). In FIG. 28, the arm of certain animals is presented in detail, mainly including a molded rigid polymer component arm base 57, and a spherical shaft coupling 56 in a position perpendicular to the arm length, for installing various components of an animal body. The bottom of the component is an opening which receives a straight connection piece (see labels 20 and 4 in FIG. 25).

Extendable joint piece of a hand: a component formed from an extendable joint piece, at some ends having a straight connection piece, at another end being a hand and two fingers. The latter is a rigid sheet-like component with no metal array (marked 4 in FIG. 29).

Elbow and wrist component: these two parts are one part of the limb, sharing the same module (marked 32 in FIG. 5) and being compact sheet formed of rigid polymer. The front is triangular, while the side is trapezoidal. Inside is a central flat surface, and a surface has a groove shaped like a water droplet, enabling the component to ensure that the pressure of the system's extendable joint piece is borne.

Front arms: compact sheet formed of rigid polymer, rectangular and triangular cross section, narrowing towards the back (marked 31 in FIG. 5). Inside the component are two perpendicular projections which attain the component length; in the middle of these projections is a groove, to ensure that the component can be used on the extendable joint piece.

As was the case with the upper limbs, the lower limbs are formed of different independent components. The lower limbs differ from the upper limbs primarily in terms of their size; they are larger and more robust, for the purpose of highlighting the fact that certain animals move on two feet. The lower limbs are explained below.

Thighs: rigid sheet, with oval cross section, round at the top, shortening towards the bottom, with a transverse flat surface at the bottom; an opening is provided, for receiving a part of a connector "male" component (marked 5 in FIG. 30), connected to the thigh by means of an extendable joint piece, the joint piece being used for constructing and anchoring the remaining parts of the lower limb (FIG. 30). At a position perpendicular to the length of the thigh is the same male spherical connection, as shown in the arm piece in FIG. 28. This connector allows the thigh to be hinged to the base body.

Knee joint: trapezoidal rigid sheet, a peripheral rounded part forming an edge of the narrowest part of the cucullaris (marked 20 in FIG. 5). In cross section, the component is "V" shaped, with filleted side edges. An inside part of the component has a structure that is perpendicular to the maximum length of the part, and in the center thereof is a groove shaped like a water droplet, connected to the extendable joint piece of the system.

Shin: a side thereof is a rhombic rigid sheet; with the longitudinal cross section is a "V" shape with rounded edges (marked 24 in FIG. 5). The interior has two structures which are perpendicular to the maximum sheet length; at the center is a groove shaped like a water droplet, connected and fixed to the extendable joint piece of the system.

Ankle: a side is a trapezoidal rigid sheet; the transverse cross section is "C" shaped (marked 21 in FIG. 5). The interior is a flat surface perpendicular to the component length; at the center is a groove shaped like a water droplet, connected to the extendable joint piece of the system.

Foot: a side is a trapezoidal rigid sheet, at the top is a female port connector, corresponding to a trapezoidal base (marked 22 in FIG. 5). This is a contact point between the lower limb sheet and the toy and the surfaces thereof. A front foot has two toes; two toe bones are not described in detail. They serve as an aesthetic component, at the same time increasing the contact surface; two feet are very heavy, and give greater stability. The tail part of the toy is also very important, and also has the effect of stabilizing posture when the toy is stationary (labels 41 and 42 in FIG. 11).

This evolutionary game system is gradually submitted to the user; first of all a basic pack is obtained, followed by different expansion packs, which can increase the number of varieties and the possibilities of different results in the system. Various packs and included contents of the evolutionary game system are presented below.

Basic pack: the user receives a series of extendable components (FIG. 4) and rigid components (FIG. 5) of a "basic pack". These components form the abovementioned base body, principally a flat structure formed by the extendable sheet materials listed above. Each animal has a head, a tail and four limbs.

The components of the basic pack allow the formation of 8 species of preset animals in 4 families (FIG. 6): insects I, fish II, amphibians III and reptiles IV. According to these configurations, the user can change and assemble components according to preference to assemble different animals (FIG. 32).

Theme pack: this class of package is regarded as a combination of the previous two classes mentioned above, in other words, includes the animals shown in FIGS. 7 to 9. An additional component set enables the basic pack to generate a greater variety of animals, or to evolve existing species (FIG. 34). For example, the insect basic pack is very simple and abstract, but after the addition of a theme pack, it is possible to create more complex and real animal insects.

These packs include modules for various regions, e.g. the animal body (64, 65, 68, 70, 74), head (58, 63, 69, 71, 75), crest (61), four limbs (66, 70), tail (72, 73), wings (62), long thin claws (59) and thick claws (60). The shaft coupling is compatible with all parts of the system, and so has no restrictions; components of different theme packs can be recombined. So far, the system comprises 6 theme packs. Dinosaurs (FIGS. 35 and 36), mammals (FIGS. 41 and 42), insects (FIG. 44), marine reptiles (FIGS. 37 and 38), dragons (FIGS. 39 and 40) and amphibians (FIG. 43).

Base body expansion pack: since components can be recombined, many types of toy are possible in the game system, but not all of these results can be attained simultaneously. At the start, there is only one base body, therefore it is not possible to create more complex animals at this stage.

Base body expansion pack accessories: the purpose of theme packs is to achieve visual appeal and obtain a greater number of animal patterns; in addition, accessory packs can add more possibilities, to obtain a completely new game experience. Is the toy an isolated entity; it must share space with other toys, and use the same environment. In view of this point, accessory design utilizes the environment to the maximum extent. We have various suction-type limbs which can be placed on smooth surfaces, such as windows, tiles and certain furniture (FIGS. 45 and 46). We also provide magnetic limbs (not shown), so as to provide this "attractive" property to allow animals to adhere by suction to various metals and surfaces that feature in the user's everyday life.

In each class of accessories, there are also custom-designed components; having components custom-made at a deeper level in this way results in modification of assembly and components. To generate different types of membrane, we designed two types of claw.

The thin claw (FIG. 48) is a single-piece, toothed hard plastic molded clamp. It has a round opening, and after the position of the opening is subjected to compression encloses in the vicinity of an extendable joint piece of the system, and performs compression by adjusting pressure. At another end thereof is a pressure-exterting component used to compress a membrane. If there are multiple components on the structural joint piece, a membrane may be installed on a frame (FIG. 47). This is a simple method, which can generate special biological structures, such as wings; the membrane may be formed of plastic or thin cardboard, to suit the user's preference.

The second class of claw has a thick, flat structure (FIG. 49), and is also a hard plastic molded single piece. A spherical connector piece is used for the entire piece; the component becomes flat at another end, and is thickened on a round compressing claw. Material enters a central horseshoe-shaped slit; the material is elastic, and is compressed between two surfaces. The accessory may also be used for structural anchoring, but the style is different, e.g. it is used as a thick, wide wing, a feather, or a simulated butterfly wing. The larger the area, the greater the number of drawing opportunities that can be provided, and it can also be used for folding.

It is important that all component joints of the expansion pack be joined or connected in the manner of the basic pack, i.e. assembled by means of two forms, i.e. male/female connectors to accomplish joining.

Preferred Example of the Present Utility Model

Most of the components in the assembly-type evolutionary game system are manufactured by a moulding process. With regard to modules containing an internal extendable structure, this structure must be soft, to allow the realization of this function.

The remaining parts are joint regions, spherical shaft couplings, head and tail pieces, which can be produced using rigid polymer. The materials must be produced in such a way that colouring enters the polymer directly so as to obtain greater durability.

The extendable array in the base body component must match a metal sheet and hole-punching by means of a punch. A hole-punched plate must be placed in a mold in order to be embedded in plastic. This is likewise suitable for extendable structural joint pieces; before the process of emptying for the purpose of being able to spray-coat, one section of wire must be led into a casting cavity.

Without further elaboration, it is believed that one skilled in the art can, using the preceding description, utilize the present invention to its fullest extent. The preceding preferred specific embodiments are, therefore, to be construed as merely illustrative, and not limitative of the remainder of the disclosure in any way whatsoever.

In the foregoing and in the examples, all temperatures are set forth uncorrected in degrees Celsius and, all parts and percentages are by weight, unless otherwise indicated.

The entire disclosures of all applications, patents and publications, cited herein and of corresponding Chinese application No. 201520789387.3, filed Oct. 12, 2015 are incorporated by reference herein.

From the foregoing description, one skilled in the art can easily ascertain the essential characteristics of this invention and, without departing from the spirit and scope thereof, can make various changes and modifications of the invention to adapt it to various usages and conditions.

The invention claimed is:

1. An assembly-type evolutionary game system comprising the following components:

a) extendable components of a base body which comprise:
- a body abdomen-side part (8);
- a first body back-side part (9);
- a second body back-side part (10);
- a third body back-side part (11);
- a fourth body back-side part (12);
- a fifth body back-side part (13); and
- a sixth body back-side part (14);

wherein the extendable components include an internal extension metal array to extend and adjust proportions of the extendable components, b) malleable structural joint pieces of the base body which comprise:
- a short straight connection structural joint piece (1) with an end comprising a straight connection piece;
- a middle straight connection structural joint piece (5) with an end comprising a straight connection piece;
- a long straight connection structural joint piece (7) with an end comprising a straight connection piece;
- a middle spherical connection structural joint piece (3) with an end comprising a spherical connection piece;
- a long spherical connection structural joint piece (6) with an end comprising a spherical connection piece;
- a mixed connection structural joint piece (2) with an end comprising a straight connection piece; and
- a hand structural joint piece (4) including a hand connection piece;

wherein the malleable structural joint pieces are configurable to hold a shape after adjustment, and c) rigid components of the base body which comprise:

a plurality of separate body parts, wherein each separate body part encloses a hollow portion and at least one clamp located at a curved portion of the body part and extending inwardly into the enclosed hollow portion within each separate body part, the plurality of separate body parts comprising:

a narrow rib (15);

a narrow limb connection main body (16);

a flat rib (18);

a flat limb connection main body (19), wherein each of the plurality of separate body parts is configured to connect to at least one of the malleable structural joint pieces extending through the hollow portion using the at least one clamp thereon;

a plurality of additional rigid components comprising:

a thigh (17);

a knee (20);

an ankle (21);

a foot (22);

a wing (23);

a shin (24);

a fish tail piece (25) or a single tail piece (26);

a reptile head (27) or a fish head (29) comprising a skull and a jaw;

a crest (28);

a head connection component (30);

a front arm (31);

an elbow and wrist component (32); and an arm (33), wherein the extendable components connect to the malleable structural joint pieces, and wherein coupling the components enables a formation of assembled components to create a diverse number of animals.

2. The assembly-type evolutionary game system according to claim 1, wherein connections between the extendable components, the malleable structural joint pieces, or the rigid components are achieved by a plurality of male/female connectors including the structural joint pieces.

3. The assembly-type evolutionary game system according to claim 2, wherein the plurality of male/female connectors includes a first type of male/female connector connection having a spherical round head entering a hemispherical connector under pressure.

4. The assembly-type evolutionary game system according to claim 2, wherein the plurality of male/female connectors includes a second type of male/female connector connection having radially arranged equidistantly distributed shafts directly entering a cavity.

5. The assembly-type evolutionary game system according to claim 1., wherein the assembled components are an insect (I), fish (II), amphibian (III), reptile and lizard (IV).

6. The assembly-type evolutionary game system according to claim 1, wherein a component of the base body is connected to one or more of the following components:

a special main body module (64, 65, 68, 74);

a head (58, 63, 67, 69, 71, 75);

a crest (61);

a limb (66, 70);

a tail piece (72, 73);

a wing (62);

a long thin claw (59); or a thick claw (60).

7. The assembly-type evolutionary game system according to claim 6, wherein the assembled components are a dinosaur, mammal, insect, marine reptile, amphibian or dragon.

8. The assembly-type evolutionary game system according to claim 1, wherein the first body back-side part differs in shape from the second body back-side part, the third body back-side part, the fourth body back-side part, the fifth body back-side part, or the sixth body back-side part.

9. The assembly-type evolutionary game system according to claim 1, wherein each of the malleable structural joint pieces includes a steel wire.

10. The assembly-type evolutionary game system according to claim 1, wherein the narrow limb connection main body includes a straight connection piece receiving portion to receive a straight connection piece on one of the malleable structural joint pieces.

11. The assembly-type evolutionary game system according to claim 10, wherein the straight connection piece includes radially arranged equidistantly distributed shafts and the straight connection piece receiving portion includes a cavity to receive the shafts.

12. The assembly-type evolutionary game system according to claim 10, wherein the straight connection piece receiving portion is positioned opposite the clamp on the narrow limb connection main body within the hollow portion.

13. The assembly-type evolutionary game system according to claim 1, wherein the flat rib connection main body includes a straight connection piece receiving portion to receive a straight connection piece on one of the malleable structural joint pieces.

14. The assembly-type evolutionary game system according to claim 13, wherein the straight connection piece includes radially arranged equidistantly distributed shafts and the straight connection piece receiving portion includes a cavity to receive the shafts.

15. The assembly-type evolutionary game system according to claim 13, wherein the straight connection piece receiving portion is positioned opposite the clamp on the narrow limb connection main body within the hollow portion.

* * * * *